US009527294B2

(12) United States Patent
Kobayashi

(10) Patent No.: US 9,527,294 B2
(45) Date of Patent: Dec. 27, 2016

(54) PRINTER

(71) Applicant: BROTHER KOGYO KABUSHIKI KAISHA, Nagoya-shi, Aichi-ken (JP)

(72) Inventor: Haruo Kobayashi, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/921,668

(22) Filed: Oct. 23, 2015

(65) Prior Publication Data

US 2016/0114585 A1 Apr. 28, 2016

(30) Foreign Application Priority Data

Oct. 28, 2014 (JP) ..... 2014-218939

(51) Int. Cl.
*B41J 2/165* (2006.01)

(52) U.S. Cl.
CPC ..... *B41J 2/16538* (2013.01); *B41J 2/16541* (2013.01); *B41J 2/16552* (2013.01); *B41J 2002/16558* (2013.01)

(58) Field of Classification Search
CPC .. B41J 2/16538; B41J 2/16541; B41J 2/16552
See application file for complete search history.

(56) References Cited

U.S. PATENT DOCUMENTS 5,266,974 A * 11/1993 Koitabashi ..... B41J 2/16538 347/33
5,381,169 A * 1/1995 Arai ..... B41J 2/16508 347/33
5,896,143 A * 4/1999 Matsui ..... B41J 2/16508 347/24
6,189,999 B1 * 2/2001 Pham ..... B41J 2/16544 347/33
6,467,873 B1 10/2002 Toba et al.
6,679,578 B2 * 1/2004 Arakawa ..... B41J 2/16547 347/33
6,769,758 B2 * 8/2004 Wanibuchi ..... B41J 2/16517 347/22
7,314,267 B2 * 1/2008 Yamaguchi ..... B41J 2/16552 347/45

(Continued)

FOREIGN PATENT DOCUMENTS

JP 2001-180013 A 7/2001

*Primary Examiner* — Stephen Meier
*Assistant Examiner* — John P Zimmermann
(74) *Attorney, Agent, or Firm* — Fox Rothschild LLP

(57) ABSTRACT

A head includes a nozzle face having a nozzle discharging a first liquid. A wiper contacts to the nozzle face and moves in relation to the nozzle face. An absorption member moistened by a second liquid absorbs the first liquid adhered to the wiper while moving in relation to the wiper and has a contact portion and a surface groove. The contact portion is provided on a side of an absorption face of the absorption member so as to come into contact with the wiper. The absorption face is a face on a side of the absorption member facing the wiper. The surface groove is provided on an absorption face side. The surface groove is recessed in a direction apart from the wiper than the contact portion and extends along an extending direction in which an edge on an absorption member side of the wiper extends.

14 Claims, 15 Drawing Sheets

(56) References Cited

U.S. PATENT DOCUMENTS

2005/0068366 A1* 3/2005 Takagi ..... B41J 2/155
347/33
2012/0327159 A1* 12/2012 Ogawa ..... B41J 2/16544
347/33

* cited by examiner

PRINTER

CROSS-REFERENCE TO RELATED APPLICATION

This application claims priority to Japanese Patent Application No. 2014-218939 filed on Oct. 28, 2014, the disclosure of which is herein incorporated by reference in its entirety.

BACKGROUND

The present disclosure relates to a printer provided with a nozzle discharging a liquid.

A known printer is provided with a carriage, a wiping member, and an ink removal member. The carriage is provided with a recording head including a nozzle forming surface. The ink removal member is disposed adjacent to the carriage and moves in conjunction with the movement of the carriage. As the carriage moves, the wiping member slides in contact with the nozzle forming surface of the recording head and removes any ink adhering to the nozzle forming surface. When the carriage moves farther, the wiping member comes into contact with the ink removal member. The ink removal member removes the ink adhering to the wiping member. The ink removed from the wiping member adheres to the ink removal member and is absorbed by the ink removal member.

SUMMARY

In this type of printer, the ink adhering to the ink removal member dries and hardens in some cases. In those cases, the surface of the ink removal member becomes clogged by the hardened ink, making it difficult for the ink removal member to absorb the ink and creating the possibility that the ink will remain on the wiping member. If the nozzle forming surface is wiped by the wiping member when ink is remaining on the wiping member, the ink removed from the nozzle forming surface may adhere to the nozzle forming surface again or get into the nozzle, causing the ink to be discharged improperly.

Various embodiments of the broad principles described herein provide a printer that decreases the possibility of improper discharge of the liquid from the nozzle will occur.

Embodiments described herein provide a printer including a head, a wiper, and an absorption member. The head is provided with a nozzle face. The nozzle face has a nozzle discharging a first liquid. The wiper is configured to contact to the nozzle face and to move in relation to the nozzle face. The absorption member is configured to be moistened by a second liquid. The absorption member is configured to absorb the first liquid adhered to the wiper while moving in relation to the wiper.

The absorption member is provided with a contact portion and at least one surface groove. The contact portion is provided on a side of an absorption face of the absorption member so as to come into contact with the wiper. The absorption face is a face on a side of the absorption member facing the wiper. The surface groove is provided on an absorption face side of the absorption member. The surface groove is a groove recessed in a direction apart from the wiper than the contact portion. The surface groove extends along an extending direction. The extending direction is a direction in which an edge on an absorption member side of the wiper extends.

BRIEF DESCRIPTION OF THE DRAWINGS

Embodiments will be described below in detail with reference to the accompanying drawings in which.

DETAILED DESCRIPTION

A configuration of a printer 1 will be explained with reference to FIGS. 1 to 8. Note that the top side, the bottom side, the lower left side, the upper right side, the lower right side, and the upper left side in FIG. 1 respectively correspond to the top side, the bottom side, the front side, the rear side, the right side, and the left side of the printer 1.

Figure 1:
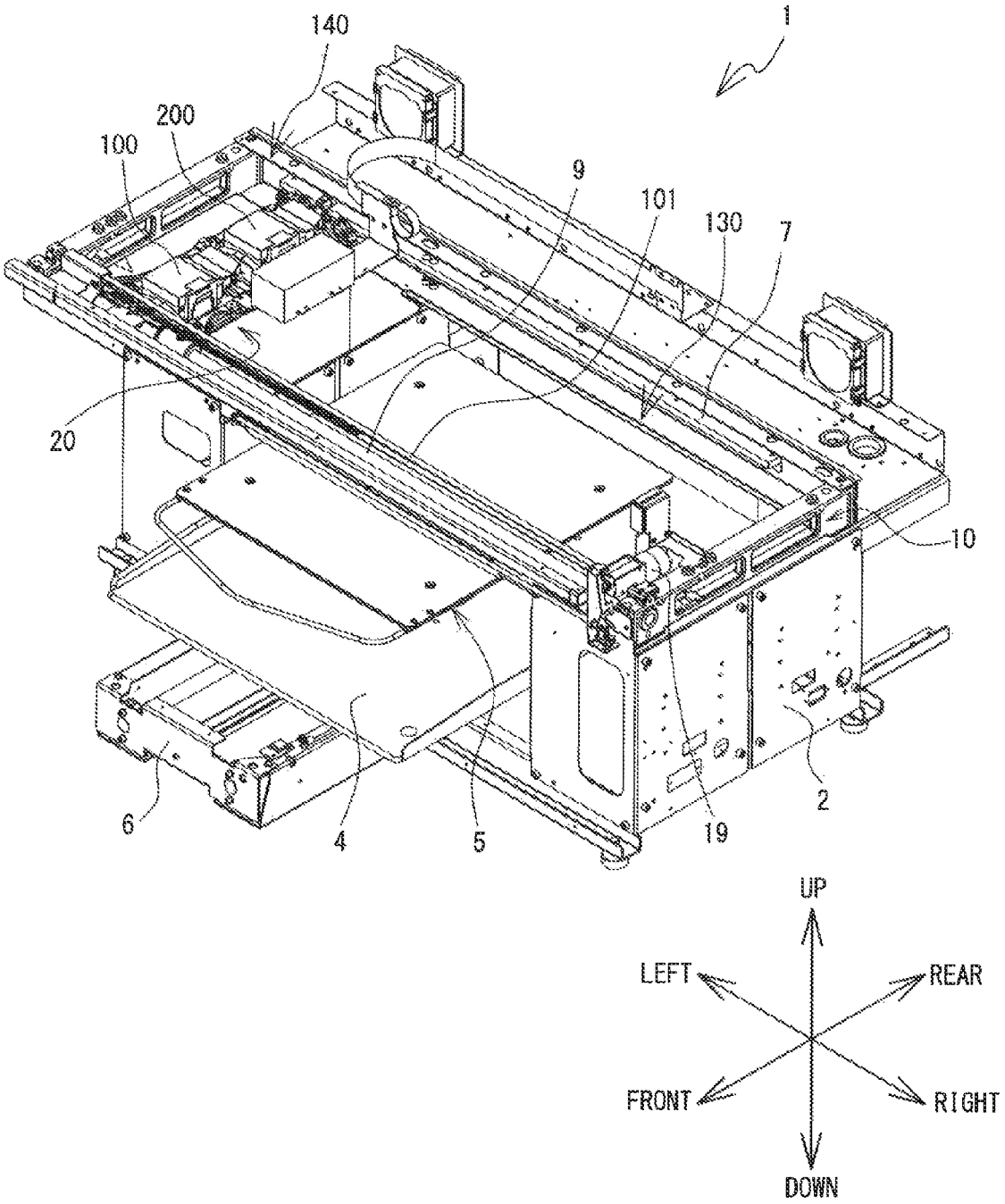
FIG. 1 is an oblique view of a printer.

As shown in FIG. 1, the printer 1 is an inkjet printer that, by discharging a liquid ink, performs printing on a cloth (not shown in the drawings), such as a T-shirt or the like, that is a printing medium. The printer 1 may also use paper or the like as the printing medium. In the present embodiment, the printer 1 is able to print a color image on the printing medium by discharging five different types of the ink (white (W), black (K), yellow (Y), cyan (C), and magenta (M)) downward. In the following explanation, of the five types of the ink, the white-colored ink will be called a white ink, and the four colored inks, black, cyan, yellow, and magenta, will be collectively called color inks.

The printer 1 is provided with a housing 2, a platen drive mechanism 6, a pair of guide rails (not shown in the drawings), a platen 5, a tray 4, a frame body 10, a guide shaft 9, a rail 7, a carriage 20, head units 100, 200, a drive belt 101, and a drive motor 19.

The housing 2 has approximately rectangular parallelepiped shape whose long axis extends from left to right. An operation portion (not shown in the drawings) for performing operations of the printer 1 is provided in a position on the right front side of the housing 2. The operation portion is provided with a display 49 (refer to FIG. 9) and an operation button 501 (refer to FIG. 9). The display 49 displays various types of information. The operation button 501 is operated when an operator inputs commands related to various types of operations of the printer 1.

The frame body 10 is a frame-like member having a substantially rectangular shape in a plan view, and it is installed in the top portion of the housing 2. The front side of the frame body 10 supports the guide shaft 9, and the rear side of the frame body 10 supports the rail 7. The guide shaft 9 is a shaft member provided with a shaft portion extending from left to right on the inner side of the frame body 10. The rail 7 is a rod-shaped member disposed opposite the guide shaft 9 and extending from left to right.

Figure 2:
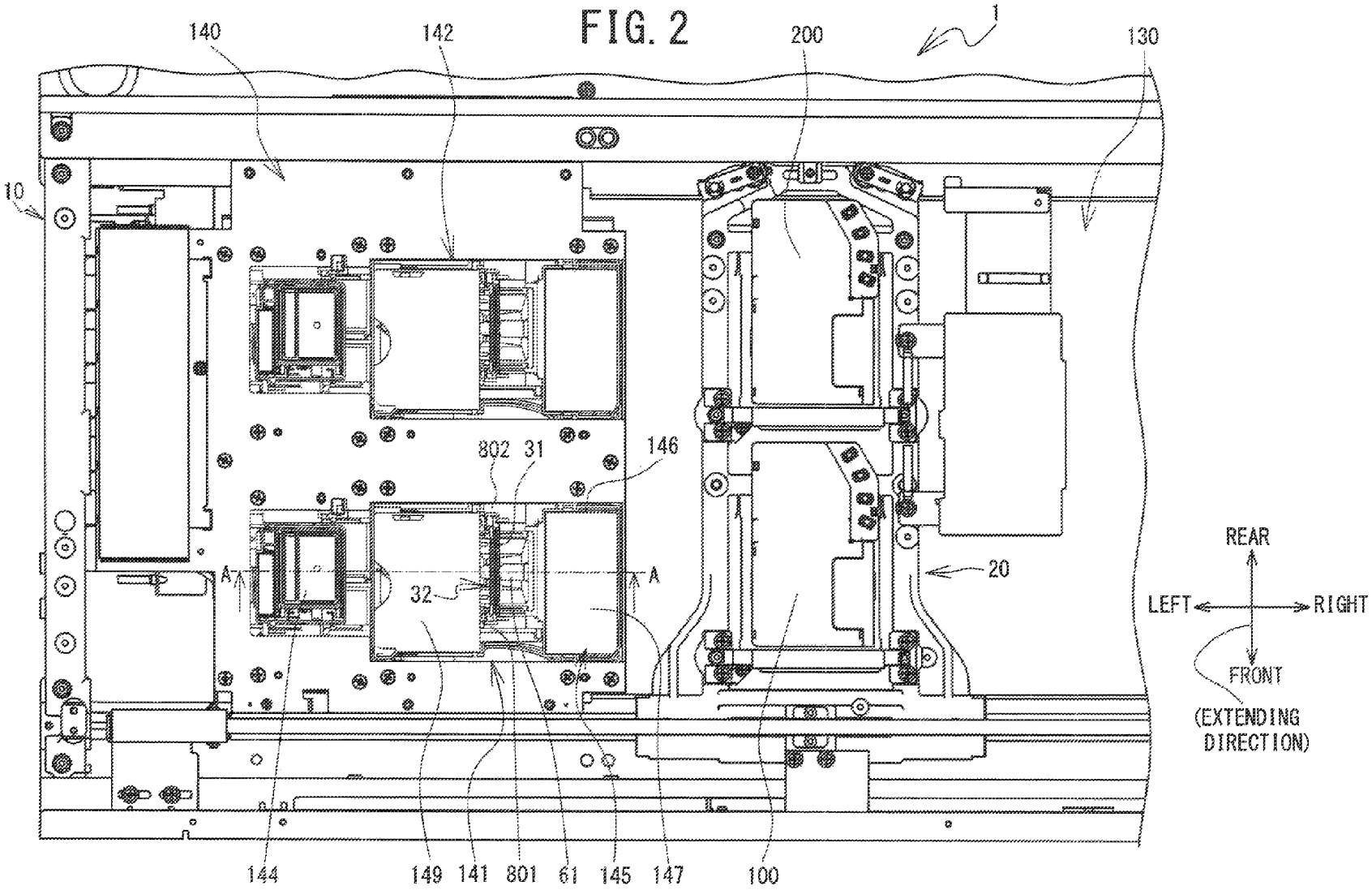
FIG. 2 is a plan view of the printer.
Figure 3:
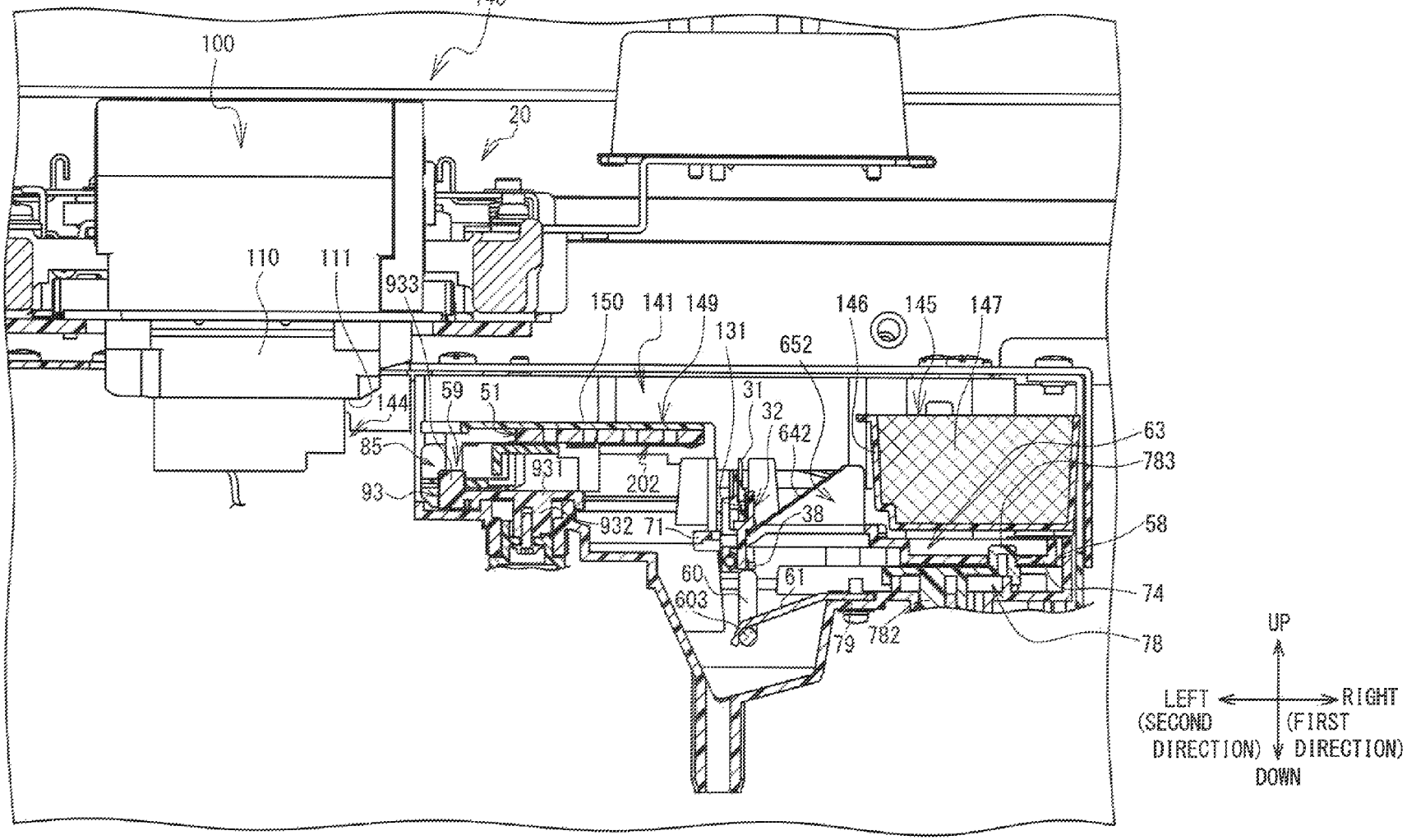
FIG. 3 is a section view taken along a line A-A in FIG. 2, in which a wiper is in a separating position and an absorption member is in a first position.

The carriage 20 is supported so as to be conveyed to the left and the right along the guide shaft 9. As shown in FIGS. 1 and 2, the head units 100, 200 are carried on the carriage 20 and are arrayed in the front-rear direction. The head unit 100 is disposed in front of the head unit 200. As shown in FIG. 3, a head 110 is provided on the bottom of each one of the head units 100, 200. A nozzle face 111 that is flat and parallel to the horizontal plane is formed on the bottom face of the each of the heads 110. Note that FIG. 3 shows the head 110 and the nozzle face 111 on the head unit 100. A plurality of tiny nozzles are provided in the nozzle face 111 that are able to discharge one of the white ink and the color inks downward.

As shown in FIG. 1, the drive belt 101 has a belt shape and spans the inner side of the frame body 10 in the left-right direction. The drive belt 101 is made of a flexible synthetic resin. The drive motor 19 is provided in the front right portion of the inner side of the frame body 10. The drive motor 19 is capable of rotating forward and in reverse, and it is coupled to the carriage 20 through the drive belt 101. When the drive motor 19 drives the drive belt 101, the carriage 20 is moved reciprocally to the left and the right along the guide shaft 9. As the head units 100, 200 are thus moved reciprocally to the left and the right, on the bottom sides of the head units 100, 200, the inks are discharged toward the platen 5 disposed to face the head units 100, 200. Printing is thus performed on the printing medium, which is supported by the platen 5.

The platen drive mechanism 6 is provided with the pair of the guide rails (not shown in the drawings) and a platen support base (not shown in the drawings). The pair of the guide rails extend from the front to the rear on the inner side of the platen drive mechanism 6 and movably support the platen support base in the front-rear direction. The top portion of the platen support base supports the platen 5. The platen 5 supports the printing medium.

The tray 4 is provided below the platen 5. In a case where the printing medium is a T-shirt, for example, the tray 4 receives the sleeves and the like of the T-shirt when the operator places the T-shirt on the platen 5. The sleeves and the like are thus protected, such that they do not come into contact with other parts in the interior of the housing 2.

The platen drive mechanism 6, by being driven by a below-described sub scanning drive portion 46 (refer to FIG. 9), moves the platen support base and the platen 5 toward the front and the rear of the housing 2 along the pair of the guide rails. As the platen 5 conveys the printing medium in the front-rear direction (the sub scanning direction), the heads 110 discharge the inks as they move reciprocally in the left-right direction. In this manner, the printing on the printing medium is performed by the printer 1.

As shown in FIGS. 1 and 2, in the present embodiment, the carriage 20 is disposed on the inner side of the frame body 10. Therefore, the heads 110 (refer to FIG. 10) move in the left-right direction between the left end and the right end of the inner side of the frame body 10. Along the path that the heads 110 travel, the area where the printing is performed by the heads 110 will be called the printing area 130. Along the path that the heads 110 travel, the area other than the printing area 130 will be called the non-printing area 140. The non-printing area 140 is an area in the left portion of the printer 1. The printing area 130 is the area from the right edge of the non-printing area 140 to the right end of the printer 1. The platen 5, the tray 4, and the like are provided in the printing area 130.

In the present embodiment, various types of maintenance operations for ensuring printing quality are performed in the non-printing area 140. For example, the maintenance operations include a flushing operation, an ink purge operation, a nozzle face wiping operation, a wiper wiping operation, and the like. The flushing operation is an operation that, before printing is performed on the printing medium, discharges the inks from the heads 110 onto a flushing receiving portion 145 (refer to FIG. 2) described later. The performing of the flushing operation makes it possible for the inks to be discharged appropriately from the heads 110, even right after the printing starts. The ink purge operation is an operation in which the nozzle faces 111 are capped by below-described nozzle caps 144 (refer to FIG. 2) and the inks are pulled out of the nozzles by suction devices (not shown in the drawings) connected to the nozzle caps 144. The performing of the ink purge operation makes it possible, for example, to decrease the possibility that air bubbles gotten inside the nozzles will be discharged along with the ink and that an ink discharge problem will be caused by the air bubbles.

The nozzle face wiping operation is an operation to wipe off excess ink remaining on the surfaces of the nozzle faces 111 by using below-described wipers 31 (refer to FIG. 6). When the ink remaining on nozzle faces 111 hardens and binds to the nozzle faces 111, there is a possibility that it will become difficult to discharge the inks from the nozzle faces 111. That possibility can be diminished by the performing of the nozzle face wiping operation. The wiper wiping operation (refer to FIGS. 12 and 13) is an operation in which ink adhering to the wipers 31 is wiped off by below-described absorption members 51 (refer to FIG. 3). In a state in which the ink wiped off from the nozzle faces 111 is adhering to the wipers 31, there is a possibility that the ink from the wipers 31 will adhere to the nozzle faces 111 the next time of performing the nozzle face wiping operation. That possibility can be diminished by the performing of the wiper wiping operation.

As shown in FIG. 2, the non-printing area 140 is provided with maintenance portions 141, 142. The maintenance portions 141, 142 are positioned below the travel paths of the head units 100, 200, respectively. The maintenance operations are performed on the head units 100, 200 in the maintenance portions 141, 142, respectively, under the control of a CPU 40 of the printer 1 (refer to FIG. 9). The configurations of the maintenance portions 141, 142 are the same. Accordingly, in the following explanation, the maintenance portion 141 will be explained.

As shown in FIGS. 2 and 3, the maintenance portion 141 is provided with the wiper 31, the nozzle cap 144, the flushing receiving portion 145, the absorption member 51 (refer to FIG. 3), and a support portion 149. The nozzle cap 144 is provided in the left portion of the maintenance portion 141. The nozzle cap 144 is a cap that is rectangular in a plan view and is open at the top. The nozzle cap 144 is able to move up and down. In a state in which the head unit 100 has moved over the nozzle cap 144, the nozzle cap 144 moves upward and covers the nozzle face 111. In this state, the ink purge operation is performed for the head unit 100. The ink that accumulates in the nozzle cap 144 is discharged into a tank (not shown in the drawings) through a discharge channel not shown in the drawings.

As shown in FIG. 3, the flushing receiving portion 145 is positioned in the right part of the maintenance portion 141 and above a wall portion 74 (refer to FIG. 3) of a below-described movement portion 63. The flushing receiving portion 145 is provided with a container portion 146 and an absorption body 147. The container portion 146 is a container that is rectangular in a plan view and is open at the top. The absorption body 147 is disposed inside the container portion 146 and is an approximately rectangular parallelepiped member that is able to absorb the ink. The flushing receiving portion 145 receives the ink discharged from the head unit 100 by the flushing operation. The ink is absorbed by the absorption body 147.

As shown in FIGS. 2 and 3, the wiper 31 is provided to the left of the flushing receiving portion 145. The wiper 31 is able to move up and down. In a state in which the wiper 31 has moved to its highest position, the moving of the carriage 20 in the left-right direction causes the wiper 31 to slide along the nozzle face 111, such that the ink is removed from the nozzle face 111 (refer to FIG. 6). In other words, the nozzle face wiping operation is performed.

The support portion 149 is provided between the wiper 31 and the nozzle cap 144 in the left-right direction. The support portion 149 supports the absorption member 51. The support portion 149 and the absorption member 51 will be described in detail later.

Figure 4:
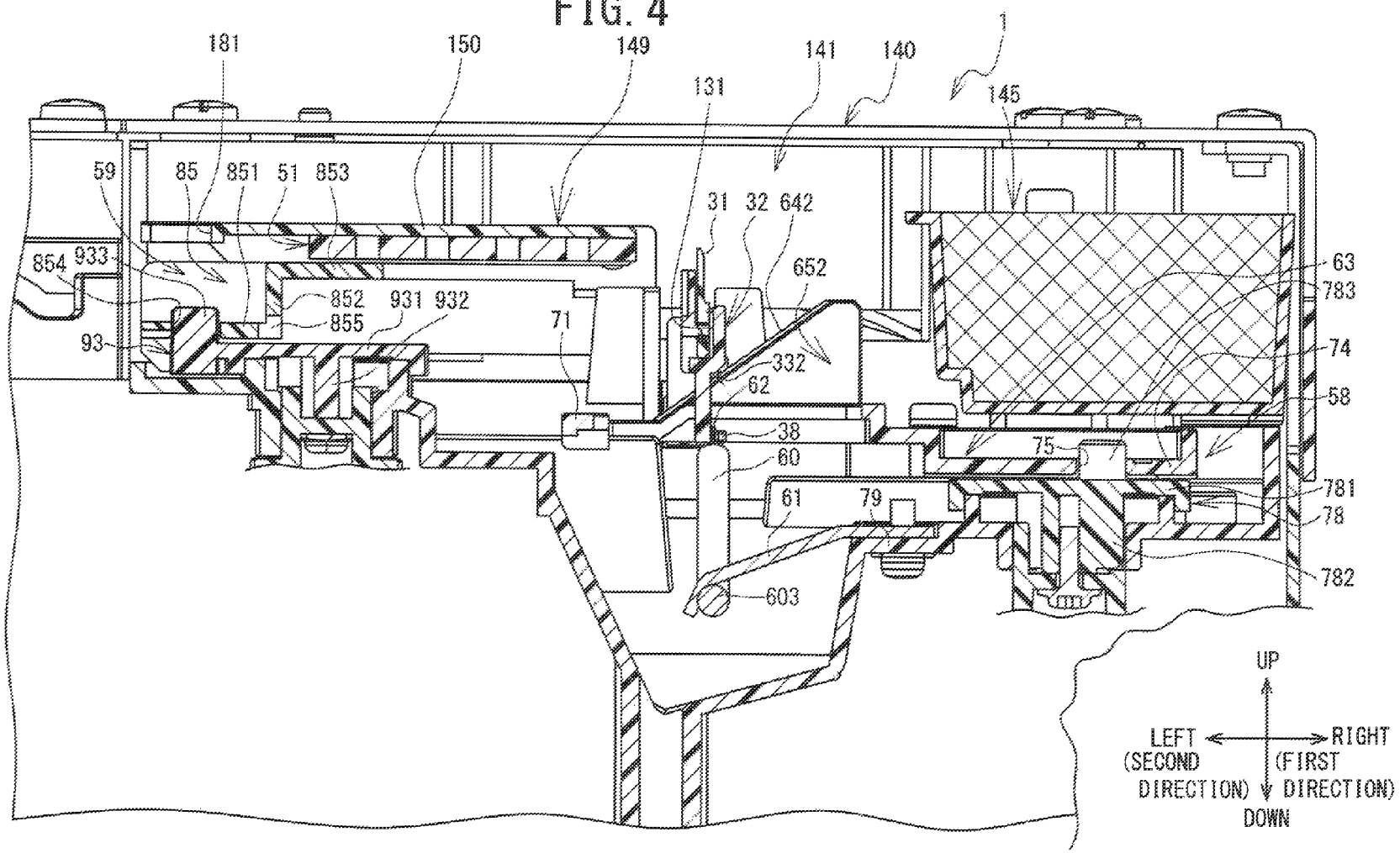
FIG. 4 is a section view in which the wiper is in a second contact position and the absorption member is in the first position.
Figure 5:
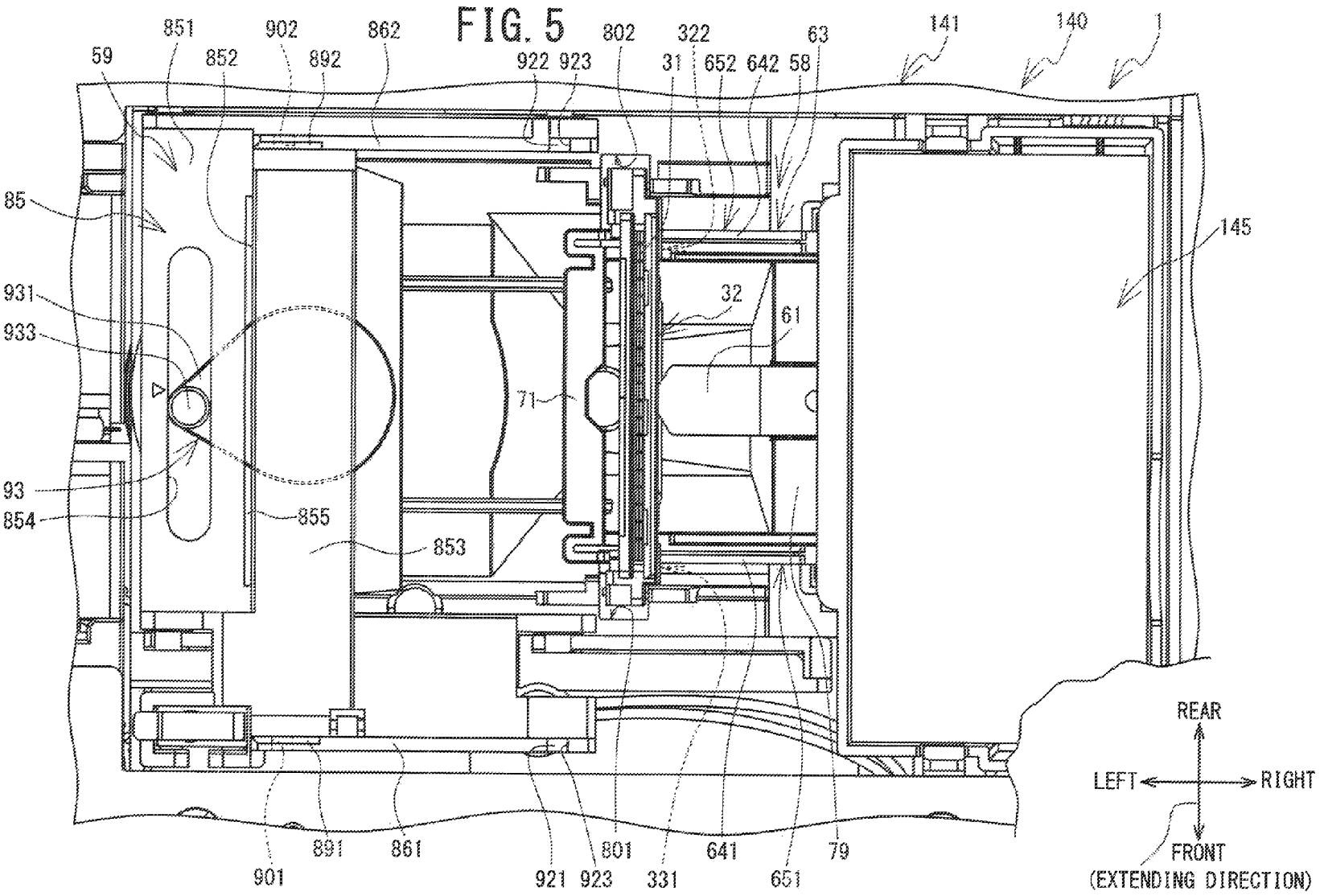
FIG. 5 is a plan view of a maintenance portion, from which a support portion and the absorption member have been removed.

The configuration that supports the wiper 31 and moves it up and down will be explained. As shown in FIGS. 3 to 5, the wiper 31, a wiper support portion 32, a second spring support portion 61 (refer to FIG. 3), guide wall portions 801, 802 (refer to FIG. 5), and a wiper drive mechanism 58 are provided in the non-printing area 140. As shown in FIG. 3, the wiper 31 is provided below the nozzle face 111 in the up-down direction. The wiper 31 extends in the front-rear direction. The top edge of the wiper 31 is parallel to the nozzle face 111. The wiper support portion 32 is provided on the bottom side of the wiper 31 and supports the wiper 31. When viewed from the left side, the wiper support portion 32 is formed into a rectangle whose long axis extends in the front-rear direction, and it has a specified width in the left-right direction (refer to FIG. 5). As shown in FIGS. 3 and 4, the wiper support portion 32 is provided with a recessed portion 131 recessed downward from the top face of the wiper support portion 32. The lower portion of the wiper 31 is disposed inside the recessed portion 131.

As shown in FIGS. 4 and 5, engaging portions 331, 332 are provided on the bottom edges of the front and rear ends, respectively, of the wiper support portion 32. The engaging portions 331, 332 each have a recessed portion recessed upward. Below-described inclined portions 641, 642 are disposed inside the respective recessed portions. The engaging portions 331, 332 engage with the inclined portions 641, 642, respectively, so as to move in relation to the inclined portions 641, 642.

As shown in FIG. 4, a pair of first spring support portions 38 set apart from one another in the front-rear direction are provided on the bottom edge of the wiper support portion 32. The pair of the first spring support portions 38 are hook-shaped and extend to the outside in the front-rear direction. The first spring support portions 38 support spring end portions 62 that are opposite ends of a single coil spring 60. The spring end portions 62 are formed into ring shapes, and they are hooked onto the hook-shaped first spring support portions 38. Note that, of the pair of the first spring support portions 38, FIG. 4 shows the first spring support portion 38 on the rear side and also shows the spring end portion 62 on the rear side, which is hooked onto the first spring support portion 38 on the rear side.

As shown in FIGS. 4 and 5, the second spring support portion 61 is positioned below the wiper support portion 32 in the up-down direction and between the pair of the first spring support portions 38 in the front-rear direction. The right end of the second spring support portion 61 is supported by a wall portion 79. The second spring support portion 61 is a metal plate and formed to extend downward toward the left from the right end supported by the wall portion 79. Also, the second spring support portion 61 is formed such that its tip is bent farther downward. As shown in FIG. 4, the coil spring 60, both ends of which are supported by the pair of the first spring support portions 38, is pulled downward, and a central portion 603 of the coil spring 60 is hooked by the bottom face of the second spring support portion 61. Thus, in a left side view, the coil spring 60 assumes a V shape in which the central portion 603 is recessed downward. As the coil spring 60 is supported by the pair of the first spring support portions 38 and the second spring support portion 61, its resilience energizes the wiper support portion 32 downward, which energizes the wiper 31 downward. The wiper support portion 32 moves up and down along the guide wall portions 801, 802 (refer to FIG. 5) in conjunction with the movements of the movement portion 63 in the left-right direction.

As shown in FIG. 5, the guide wall portions 801, 802 extend in the up-down direction and are formed such that they respectively follow the contours of the front and rear edges of the wiper support portion 32 in a plan view. The guide wall portion 801 is provided with a pair of wall faces that face one another in the left-right direction across the front end of the wiper support portion 32. The guide wall portion 802 is provided with a pair of wall faces that face one another in the left-right direction across the rear end of the wiper support portion 32. Therefore, the guide wall portions 801, 802 are able to restrict the movement of the wiper support portion 32 in the left-right direction. The guide wall portions 801, 802 guide the up-down movements of the wiper 31 and the wiper support portion 32, specifically guiding them among a first contact position (refer to FIG. 6), a second contact position (refer to FIGS. 4 and 11), and a separating position (refer to FIG. 3).

Figure 6:
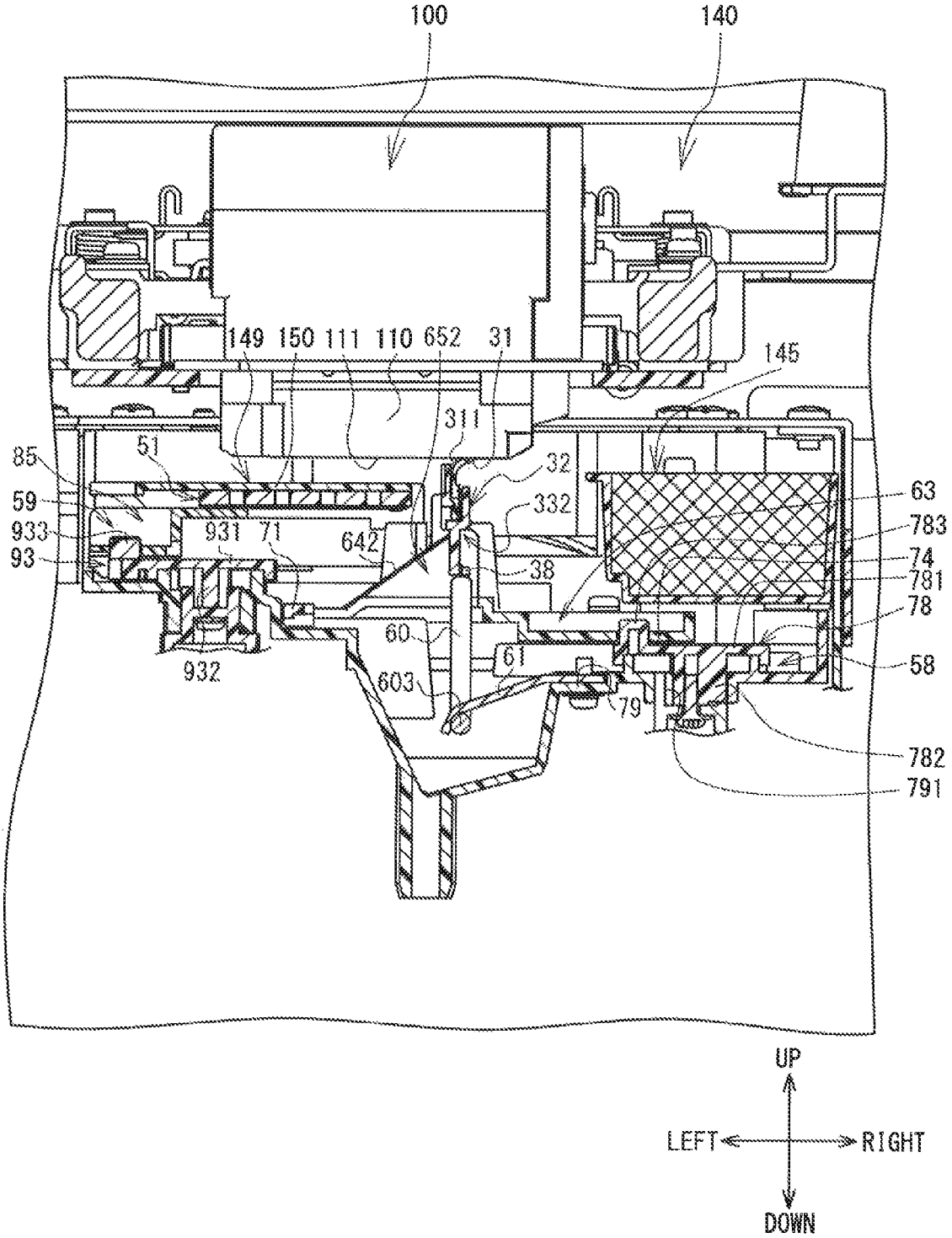
FIG. 6 is a section view showing a state in which the wiper is in a first contact position and a nozzle face wiping operation is performed.
Figure 11:
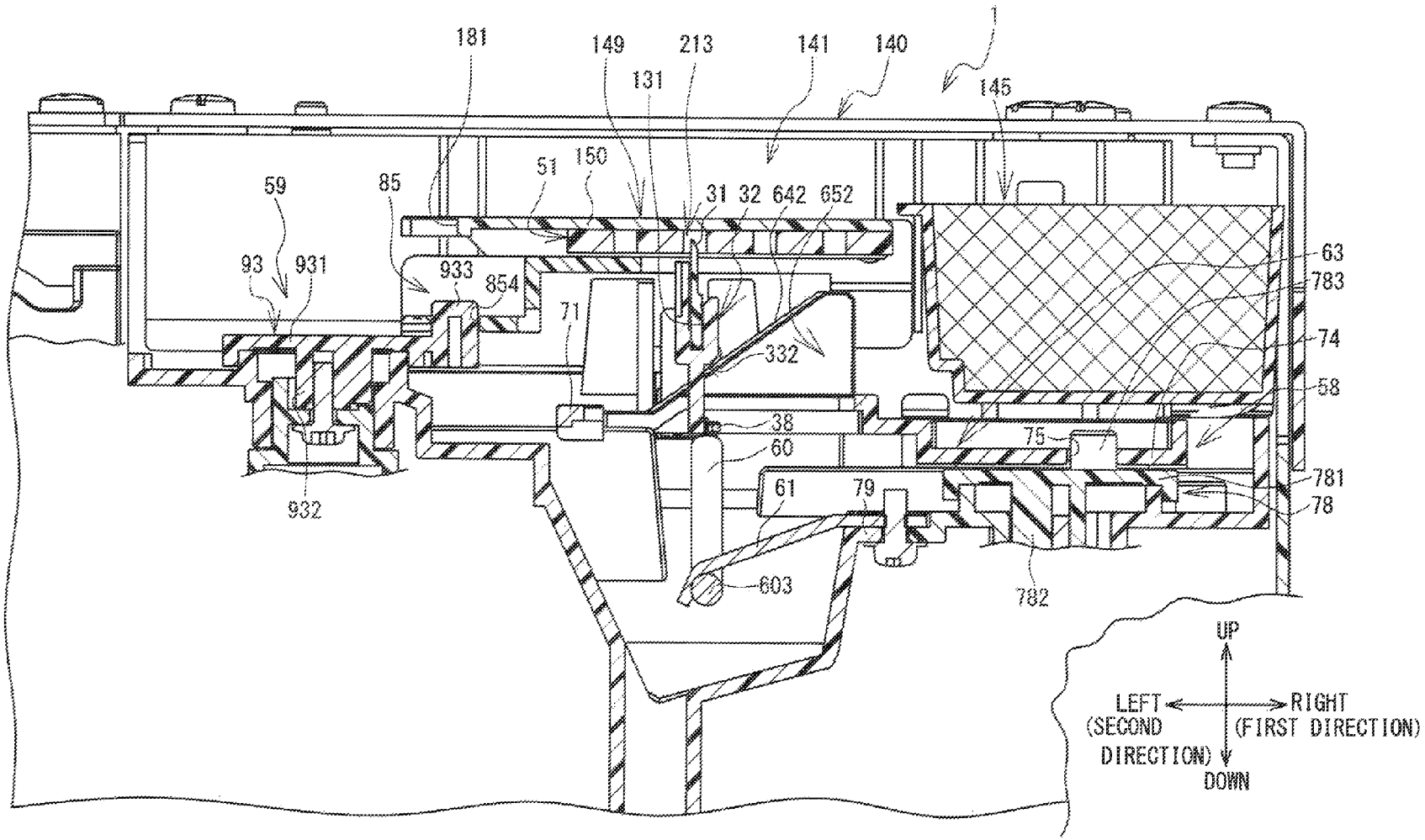
FIG. 11 is a section view in which the wiper is in the second contact position and the absorption member is in a second position.

As shown in FIG. 6, the first contact position is a position of the wiper 31 and the wiper support portion 32 in which the wiper 31 is able to be in contact with the nozzle face 111. In the first contact position, the wiper support portion 32 is engaged with the upper ends of the inclined portions 641, 642 (described later). As shown in FIGS. 4 and 11, the second contact position is a position of the wiper 31 and the wiper support portion 32 in which the wiper 31 is able to be in contact with the absorption member 51. In the second contact position, the wiper support portion 32 is engaged with the inclined portions 641, 642 (described later) slightly below their centers in the up-down direction. As shown in FIG. 3, the separating position is a position of the wiper 31 and the wiper support portion 32 in which the wiper 31 has separated from both the nozzle face 111 and the absorption member 51. In the separating position, the wiper support portion 32 is engaged with the lower ends of the inclined portions 641, 642 (described later).

The wiper drive mechanism 58 will be explained. The wiper drive mechanism 58 is a mechanism that moves the wiper 31 and the wiper support portion 32 up and down. As shown in FIG. 4, the wiper drive mechanism 58 includes the movement portion 63 and a rotating member 78.

As shown in FIGS. 4 and 5, the movement portion 63 is provided with opposing wall portions 651, 652 and the wall portion 74. The pair of the opposing wall portions 651, 652 face one another in the front-rear direction and are substantially triangular in a side view. The opposing wall portions 651, 652 are respectively provided with the inclined portions 641, 642.

The pair of the inclined portions 641, 642 face one another in the front-rear direction. The pair of the inclined portions 641, 642 are formed on the upper parts of the opposing wall portions 651, 652, respectively, and are components that extend obliquely downward toward the left. The inclined portions 641, 642 move the wiper 31 and the wiper support portion 32 in the up-down direction in conjunction with the movements of the movement portion 63 in the left-right direction.

An extension portion 71 spans the gap between the lower ends of the inclined portions 641, 642. The extension portion 71 is plate-shaped and parallel to the horizontal plane. As shown in FIG. 4, the wall portion 74 is a wall portion that is rectangular in a plan view. The left parts of both the front and the rear edges of the wall portion 74 are connected to the lower parts of the right edges of the opposing wall portions 651, 652, respectively. An oblong hole 75 is provided in the right part of the wall portion 74. In a plan view, the oblong hole 75 has the same shape as an oblong hole 854 (refer to FIG. 5) that will be described later. The oblong hole 75 passes through the wall portion 74 in the up-down direction and extends in the front-rear direction.

The movement portion 63 moves in the left-right direction in conjunction with the rotation of the rotating member 78. The rotating member 78 is positioned below the wall portion 74. The rotating member 78 is rotated by the operation of a second drive portion 95 (refer to FIG. 9) that will be described later. The rotating member 78 is provided with a rotating wall portion 781, a drive shaft 782, and a shaft portion 783. The rotating wall portion 781 is a wall portion that faces the wall portion 74 from below the wall portion 74. The rotating wall portion 781 is circular in a plan view. The drive shaft 782 extends in the up-down direction, and its upper end is connected to the center of the bottom face of the rotating wall portion 781. The drive shaft 782 is connected to the second drive portion 95 (refer to FIG. 9), which will be described later.

The shaft portion 783 extends in the up-down direction, and its lower end is connected to the outer circumferential portion of the top face of the rotating wall portion 781. The shaft portion 783 is positioned to the outside of the rotational center of the drive shaft 782. The shaft portion 783 is inserted through the oblong hole 75 in the same manner that a shaft portion 933 (refer to FIG. 5) is inserted through the oblong hole 854 (refer to FIG. 5), which will be described later.

Figure 7:
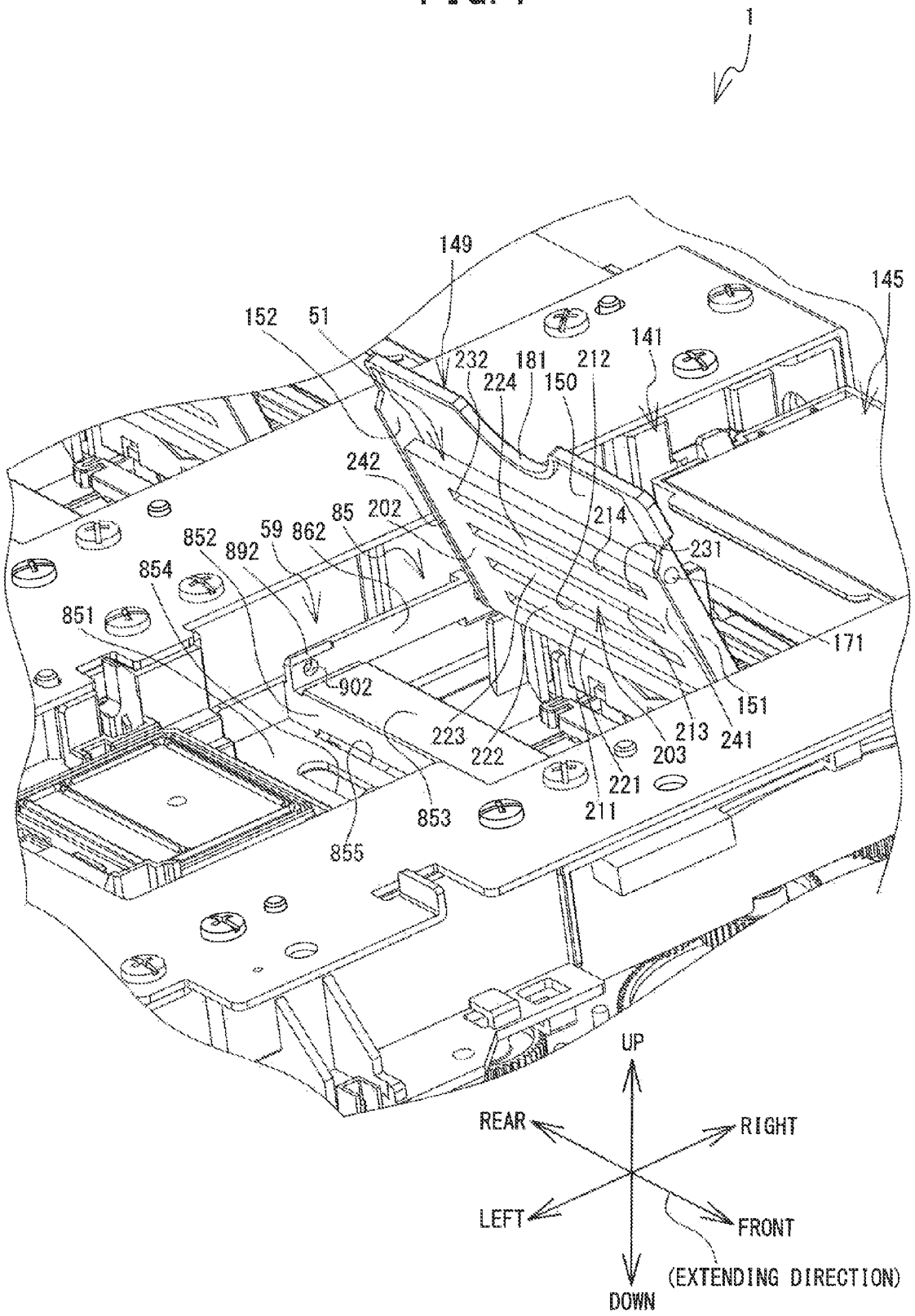
FIG. 7 is an oblique view of the maintenance portion, in which the support portion and the absorption member are in an inclined state.

The configuration that supports the absorption member 51 and moves it to the left and the right will be explained. In the following explanation, the front-rear direction in which the upper edge on the absorption member 51 side of the wiper 31 extends will sometimes be called the extending direction. Note that the support portion 149 and the absorption member 51 shown in FIG. 7 are in an inclined state, having rotated clockwise in a front view from the orientation of the support portion 149 and the absorption member 51 shown in FIG. 4 (an orientation in which the support portion 149 is parallel to the horizontal plane; hereinafter called the mounted orientation). However, the leftward direction and the rightward direction that are referenced when the support portion 149 and the absorption member 51 are explained with reference to FIG. 7 are the directions when the support portion 149 and the absorption member 51 are in the mounted orientation (refer to FIGS. 4 and 12).

Figure 8:
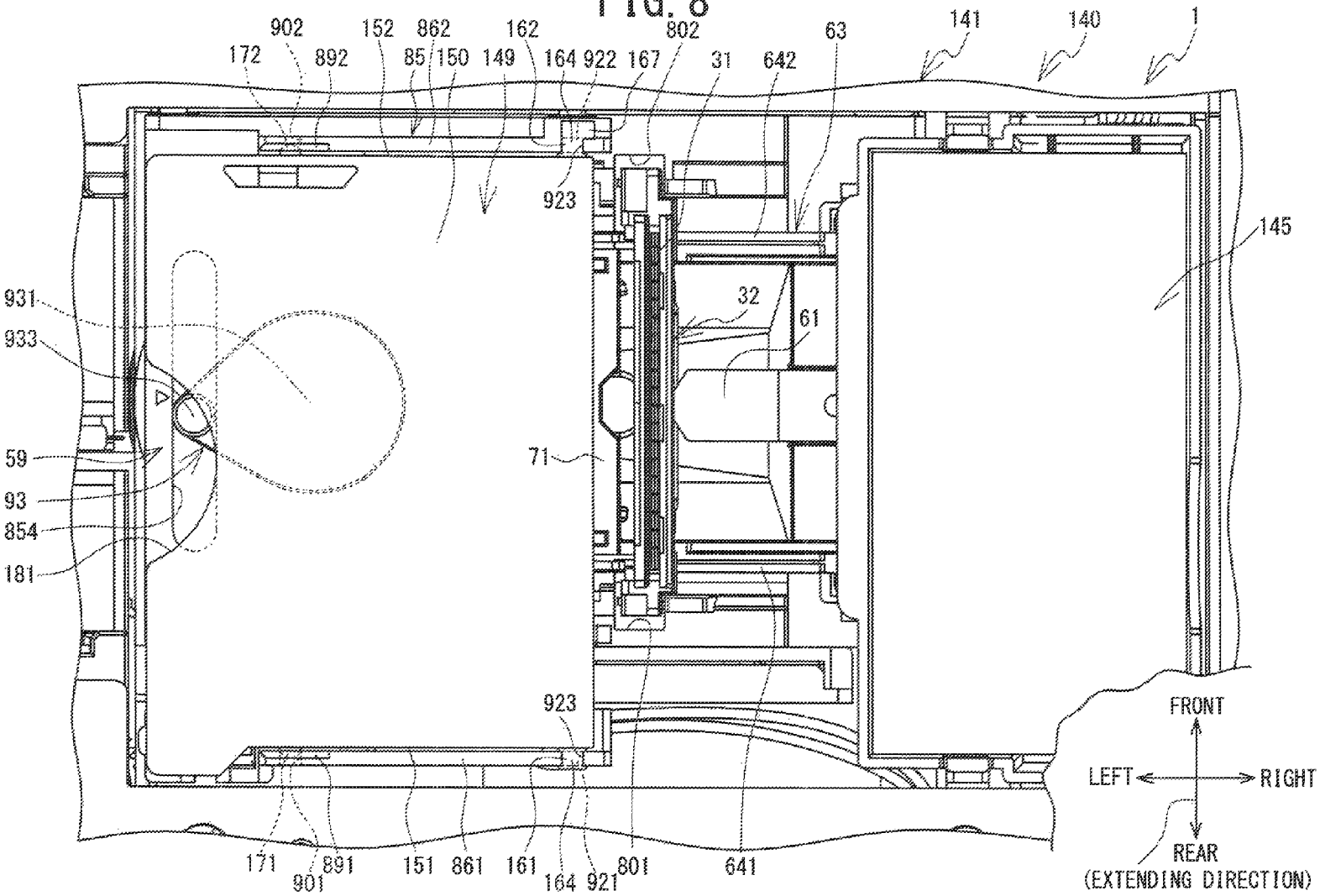
FIG. 8 is a plan view of the maintenance portion with the support portion mounted.

As shown in FIG. 4, the absorption member 51, the support portion 149, and an absorption drive mechanism 59 are provided in the non-printing area 140. As shown in FIGS. 7 and 8, the support portion 149 is provided with an upper wall portion 150, side walls 151, 152, engagement lugs 161, 162, and projections 171, 172. In a plan view, the upper wall portion 150 has a substantially rectangular plate shape that extends horizontally. A recessed portion 181 recessed toward the right in a circular arc is provided on the left edge of the upper wall portion 150. The side walls 151, 152 extend downward from the front and rear edges, respectively, of the upper wall portion 150. The side walls 151, 152 extend from slightly to the right of the left edge of the upper wall portion 150 all the way to the right edge of the upper wall portion 150.

As shown in FIG. 8, the engagement lugs 161, 162 are lugs that extend in the extending direction from the front and rear edges, respectively, of the support portion 149, or more specifically, from the right ends of the side walls 151, 152, respectively. The engagement lugs 161, 162 can be mounted in and removed from engagement slots 921, 922 that will be described later (refer to FIGS. 14 and 15). As shown in an enlarged view W3 in FIG. 15, the engagement lug 162 is provided with flat faces 163, 164, rounded faces 165, 166, and a projecting portion 167. In the same manner as the engagement lug 162, the engagement lug 161 is provided with the flat faces 163, 164 and the rounded faces 165, 166, although they are not shown in the drawings. The distance that the engagement lug 162 projects in the extending direction from the side wall 152 is greater than the distance that the engagement lug 161 projects in the extending direction from the side wall 151 (refer to FIG. 8). Specifically, the engagement lug 161 is not provided with the projecting portion 167. Note that in the enlarged view W3 in FIG. 15, of the engagement lugs 161, 162, only the engagement lug 162 is shown in the drawing, and the support portion 149 is in a state in which it extends upward.

The flat faces 163, 164 of the engagement lugs 161, 162 are faces that are orthogonal to and connected with the side walls 151, 152, respectively, of the support portion 149, and are parallel to an absorption face 202 that will be described later. The rounded faces 165, 166 are faces that are orthogonal to and connected with the side walls 151, 152, respectively, of the support portion 149, and are connected to the edges of the flat faces 163 and the flat faces 164. The rounded faces 165, 166 of the engagement lugs 161, 162 have circular arc shapes that respectively conform to the shapes of the engagement slots 921, 922, which will be described later. In a state in which the support portion 149 extends upward, the flat faces 163, the flat faces 164, the rounded faces 165, and the rounded faces 166 are formed on the left faces, the right faces, the top faces, and the bottom faces of the engagement lugs 161, 162, respectively. The distance between the flat face 163 and the flat face 164 is shorter than the left-to-right width of an opening 923 in each of the engagement slots 921, 922. The distance between the rounded face 165 and the rounded face 166 is longer than the left-to-right width of the opening 923 in each of the engagement slots 921, 922 and slightly shorter than the diameter of each of the engagement slots 921, 922.

The projecting portion 167 of the engagement lug 162 projects from the extending direction end of the engagement lug 162, in a direction from the rounded face 165 toward the rounded face 166. In a case where the support portion 149 is mounted on a mount portion 85, an inner face (a front face) of the projecting portion 167 of the engagement lug 162 comes into contact with a side wall 862 of the mount portion 85 (refer to FIG. 14).

Figure 14:
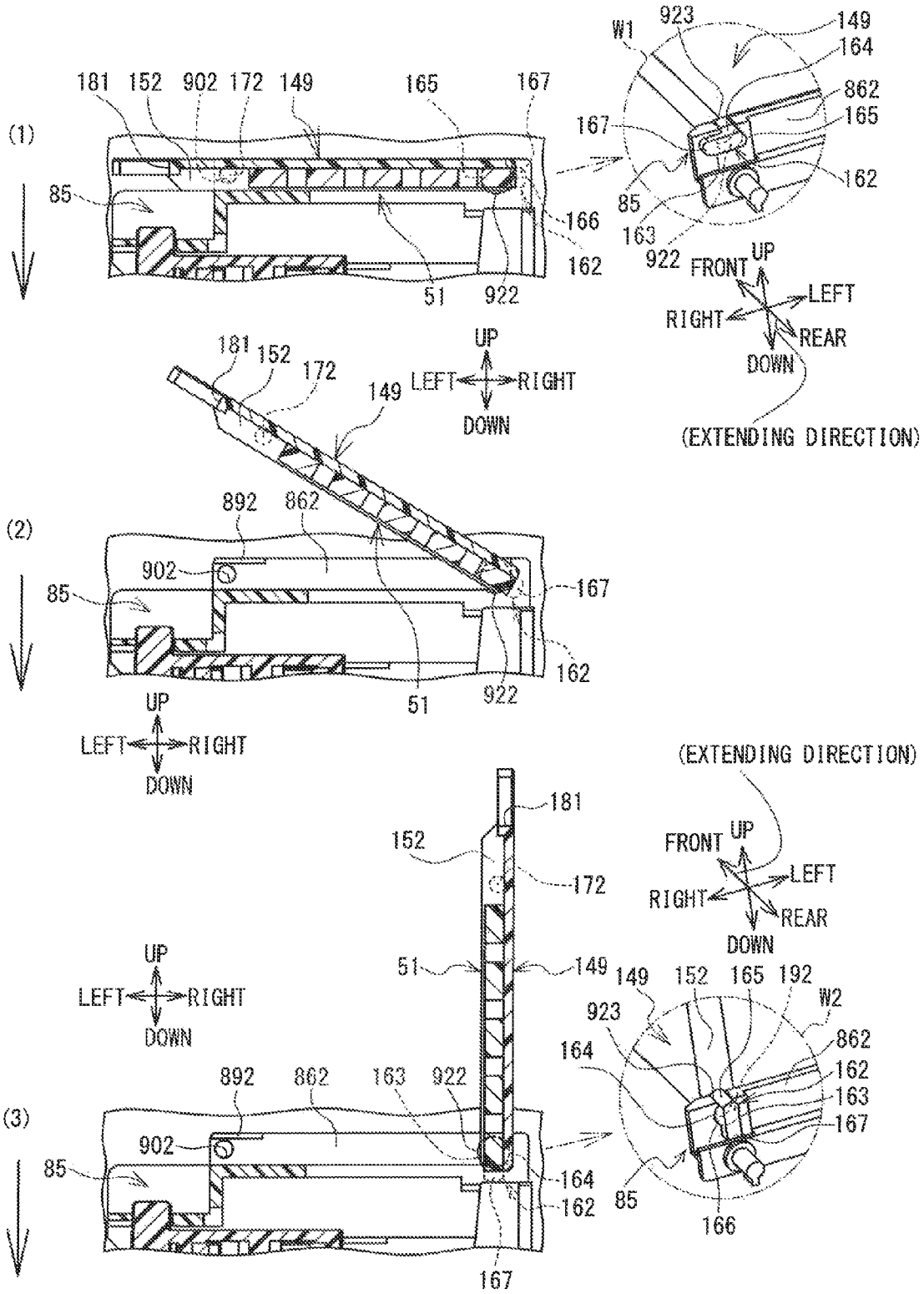
FIG. 14 is a state transition diagram showing a mode in which the absorption member is replaced.

As shown in FIGS. 7, 8, and 14, the projections 171, 172 project in the extending direction from the left ends of the side walls 151, 152, respectively. The tips of the projections 171, 172 are each rounded. The manner in which the support portion 149 is mounted on and removed from the mount portion 85 will be described later.

As shown in FIG. 7, the absorption member 51 is stuck onto the bottom face of the upper wall portion 150 of the support portion 149. The absorption member 51 is rectangular in a plan view and is positioned between the side walls 151, 152. The absorption member 51 is formed from a material that is able to absorb a liquid, such as sponge, felt, or the like, for example, and it absorbs the ink adhering to the wiper 31. The absorption member 51 is also moistened by a moistening solution 98 (refer to part (2) in FIG. 15). The moistening solution 98 contains a moistening agent 96 and uses water 97 as its solvent (refer to part (2) in FIG. 15).

The face on the bottom side of the absorption member 51, which is the side toward the wiper 31, will be called the absorption face 202. The absorption face 202 is provided with a contact portion 203 and a plurality of surface grooves 211 to 214. The contact portion 203 is provided on the absorption face 202 and is the portion of the absorption face 202 that comes into contact with the wiper 31. The contact portion 203 is the region of the absorption face 202 that is not included in the regions that are formed by the surface grooves 211 to 214.

The surface grooves 211 to 214 each extend in the extending direction. The surface grooves 211 to 214 are slots that are recessed upward from the contact portion 203 in the direction away from the wiper 31. Note that in the present embodiment, the surface grooves 211 to 214 extend upward through the absorption member 51, but it is also acceptable for them not to extend through the absorption member 51, as long as they are recessed upward.

Figure 12:
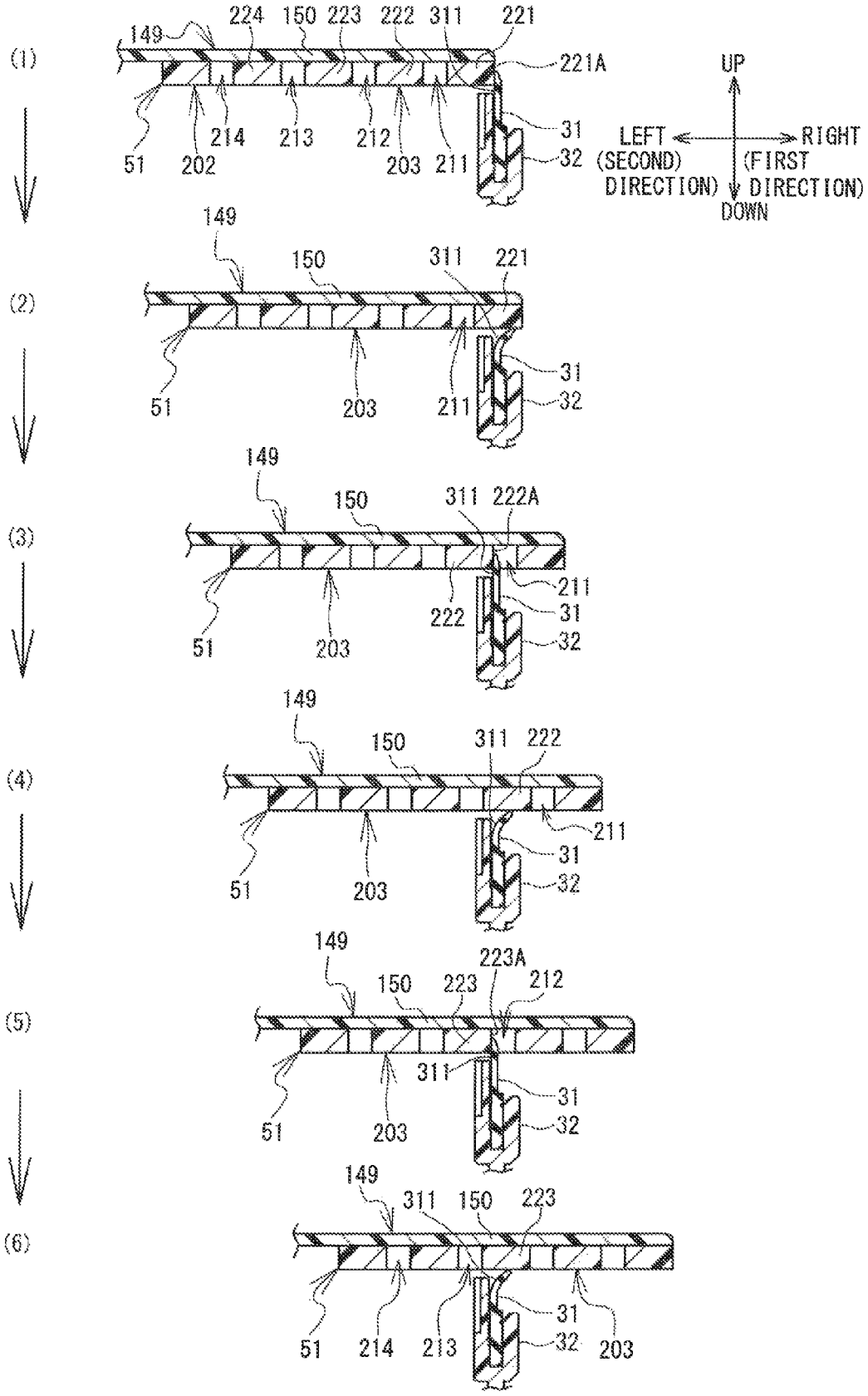
FIG. 12 is a state transition diagram showing a process by which the absorption member moves from the first position to the second position in the wiper wiping processing.

As shown in FIG. 12, the surface groove 211 is provided in the right end portion of the absorption member 51. The surface groove 212 is provided to the left of the surface groove 211. The surface groove 213 is provided to the left of the surface groove 212. The surface groove 214 is provided to the left of the surface groove 213, in the left end portion of the absorption member 51. In other words, the surface grooves 211 to 214 are provided such that they are separated from one another in the left-right direction. In the following explanation, the region of the contact portion 203 to the right of the surface groove 211 will be called the first region 221, and the region between the surface groove 211 and the surface groove 212 will be called the second region 222. The region of the contact portion 203 between the surface groove 212 and the surface groove 213 will be called the third region 223, and the region between the surface groove 213 and the surface groove 214 will be called the fourth region 224.

As shown in FIGS. 5 and 7, the absorption drive mechanism 59 includes the mount portion 85 and a rotating member 93. The support portion 149 and the absorption member 51 are moved horizontally in the left-right direction by the operation of the absorption drive mechanism 59. The mount portion 85 is a member on which the support portion 149 is mounted. The mount portion 85 is provided with a first wall portion 851, a second wall portion 852, a third wall portion 853, a side wall 861, and the side wall 862.

In a plan view, the first wall portion 851 is rectangular, with its long axis extending in the front-rear direction, and it is a wall portion that forms the left end portion of the mount portion 85. The first wall portion 851 is provided with the oblong hole 854. The oblong hole 854 passes through the first wall portion 851 in the up-down direction, with its long axis extending in the front-rear direction. The shaft portion 933, which will be described later, is inserted through the oblong hole 854.

The second wall portion 852, which extends upward, is connected to the right edge of the first wall portion 851. A hole 855 that extends in the front-rear direction is provided in the part where the first wall portion 851 and the second wall portion 852 are connected. The third wall portion 853 is connected to the upper edge of the second wall portion 852. The third wall portion 853 is rectangular in a plan view, with its long axis extending in the front-rear direction. The side walls 861, 862 extend upward from the front and rear edges, respectively, of the third wall portion 853, and extend toward the right from the third wall portion 853.

As shown in FIGS. 5 and 8, the engagement slots 921, 922 are provided in the right end portions of the side walls 861, 862, respectively. The engagement slots 921, 922 pass through the side walls 861, 862, respectively, in the extending direction. The openings 923 in the engagement slots 921, 922 are open upward, on the side toward the head 110. More specifically, as shown in part (1) in FIG. 15, the engagement slots 921, 922 are circular in a side view, and their upper edges are the openings 923, which are open upward. As shown in FIG. 8, in a case where the support portion 149 has been mounted on the mount portion 85, the engagement lugs 161, 162 are disposed inside the engagement slots 921, 922, respectively. Note that it is also acceptable for the engagement slots 921, 922 not to extend through the side walls 861, 862, as long as the engagement slots 921, 922 are formed in the extending direction such that the engagement lugs 161, 162 can be disposed therein.

As shown in FIGS. 5, 7, and 8, chamfers 891, 892 are provided in the left end portions of the side walls 861, 862, respectively. The chamfers 891, 892 are areas on the inner sides, in the front-rear direction, of the side walls 861, 862 that have been cut away such that they slope downward from the upper edges of the side walls 861, 862. Holes 901, 902 that pass through the side walls 861, 862, respectively, in the extending direction are provided in the side walls 861, 862, below the chamfers 891, 892, respectively. In a case where the support portion 149 has been mounted on the mount portion 85, the projections 171, 172 are in a state of being disposed inside the holes 901, 902, which restricts the movement of the support portion 149 in the up-down direction. The manner in which the support portion 149 is mounted on and removed from the mount portion 85 will be described later.

The mount portion 85 moves in the left-right direction in conjunction with the rotation of the rotating member 93. As shown in FIGS. 4 and 5, the rotating member 93 is disposed below the first wall portion 851, the second wall portion 852, and the third wall portion 853 of the mount portion 85. The rotating member 93 is provided with a rotating wall portion 931, a drive shaft 932 (refer to FIG. 4), and the shaft portion 933. The rotating wall portion 931 is a wall portion that is substantially circular in a plan view. The drive shaft 932 extends in the up-down direction, and its upper end is connected to the center of the bottom face of the rotating wall portion 931. The drive shaft 932 is connected to the second drive portion 95 (refer to FIG. 9), which includes a motor, a gear, and the like. The drive shaft 932 rotates the rotating wall portion 931 by rotating in conjunction with the operation of the second drive portion 95.

The shaft portion 933 extends in the up-down direction, and its lower end is connected to the outer circumferential portion of the top face of the rotating wall portion 931. The shaft portion 933 is positioned to the outside of the rotational center of the drive shaft 932 and is inserted through the oblong hole 854. The manner in which the absorption drive mechanism 59 moves the support portion 149 and the absorption member 51 will be described later.

Figure 9:
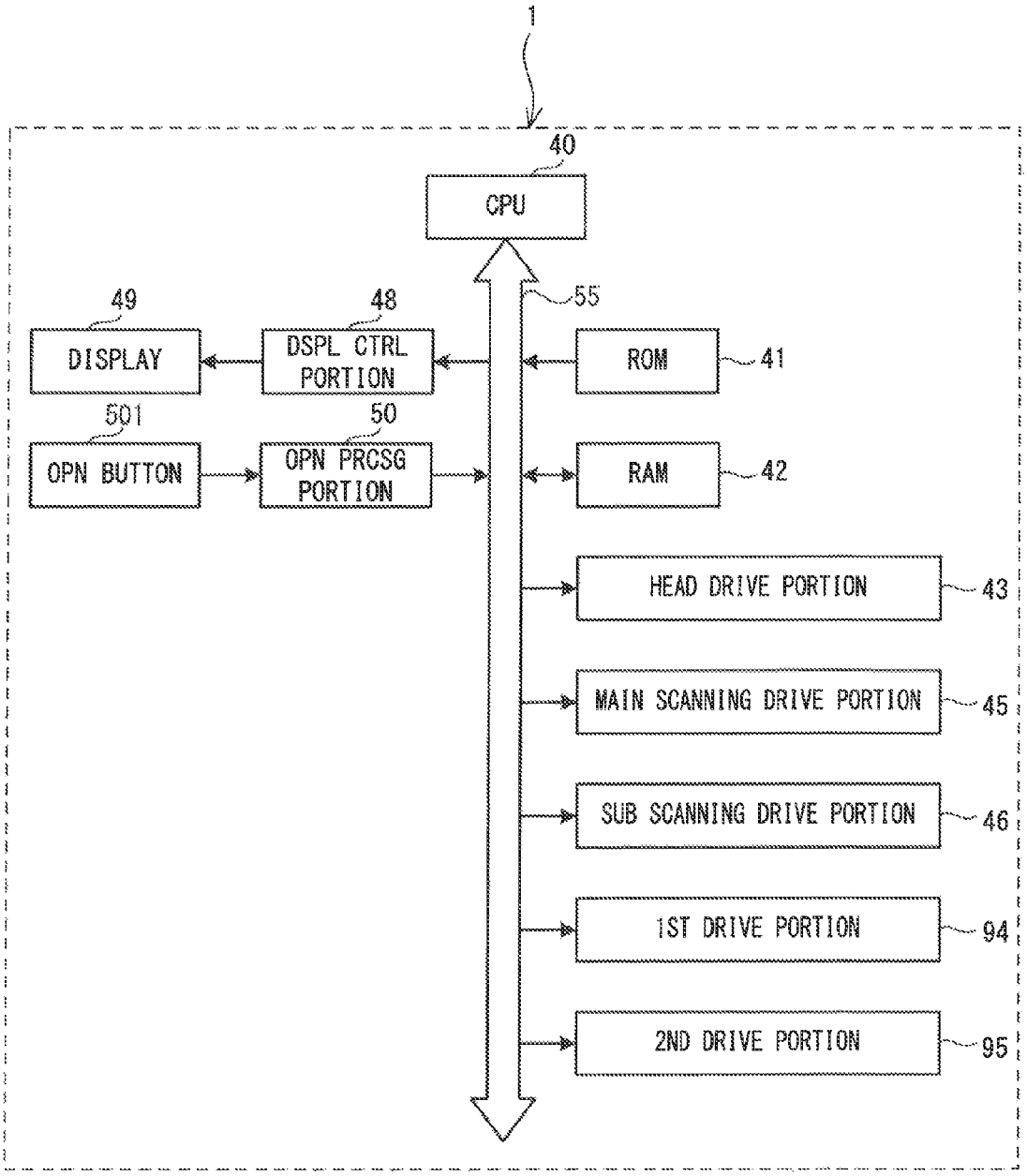
FIG. 9 is a block diagram of an electrical configuration of the printer.

An electrical configuration of the printer 1 will be explained with reference to FIG. 9. The printer 1 is provided with the CPU 40, which controls the printer 1. A ROM 41, a RAM 42, a head drive portion 43, a main scanning drive portion 45, the sub scanning drive portion 46, a first drive portion 94, the second drive portion 95, a display control portion 48, and an operation processing portion 50 are electrically connected to the CPU 40 through a bus 55.

ROM 41 stores a control program for the controlling of the printer 1 by the CPU 40, initial values and the like. Various types of data that are used by the control program are temporarily stored in the RAM 42. The head drive portion 43 is electrically connected to the head 110, which discharges the inks. The head drive portion 43 causes the inks to be discharged from the nozzles by operating piezoelectric elements provided in individual discharge channels of the head 110 (refer to FIG. 3).

The main scanning drive portion 45 includes the drive motor 19 (refer to FIG. 1), and moves the carriage 20 in the left-right direction (the main scanning direction). The sub scanning drive portion 46 includes a motor, a gear, and the like that are not shown in the drawings, and moves the platen 5 (refer to FIG. 1) in the front-rear direction (the sub scanning direction) by operating the platen drive mechanism 6 (refer to FIG. 1).

The first drive portion 94 includes a first drive motor, a gear, and the like that are not shown in the drawings, and drives the absorption drive mechanism 59. The absorption drive mechanism 59 moves the support portion 149 and the absorption member 51 in the left-right direction in conjunction with the driving of the first drive portion 94. The second drive portion 95 includes a second drive motor, a gear, and the like that are not shown in the drawings, and drives the wiper drive mechanism 58. The wiper drive mechanism 58 moves the wiper 31 and the wiper support portion 32 in the up-down direction in conjunction with the driving of the second drive portion 95. The display control portion 48 controls displays on the display 49. The operation processing portion 50 takes an operation input to the operation button 501 and outputs it to the CPU 40.

The wiper wiping operation will be explained. As shown in FIG. 6, when the ink is removed from the nozzle face 111 by the nozzle face wiping operation, the ink adheres to the wiper 31. Note that the nozzle face wiping operation is performed by moving the wiper 31 and the wiper support portion 32 to the first contact position and moving the head 110 in the left-right direction. The wiper wiping operation is performed after the nozzle face wiping operation has been performed, and the ink is wiped off from the wiper 31 by the absorption member 51. The wiper wiping operation is performed by controlling the printer 1 such that the CPU 40 reads the control program stored in the ROM 41 and performs the wiper wiping processing (refer to FIG. 10).

Assume that the wiper 31 is in the separating position, as shown in FIG. 3. At this time, the shaft portion 783 and the movement portion 63 are positioned at their rightmost positions. In the following explanation, the rightward direction, which is one direction in the horizontal plane, will sometimes be called the first direction. Furthermore, the leftward direction, which is the opposite direction from the first direction, will sometimes be called the second direction.

The CPU 40 operates the second drive portion 95 (refer to FIG. 9) to move the wiper 31 from the separating position (refer to FIG. 3) to the second contact position (refer to FIG. 4) (Step S1). More specifically, as shown in FIG. 3, the second drive portion 95 is operated to rotate the rotating wall portion 781 through the drive shaft 782, thus rotating the shaft portion 783 around the drive shaft 782. As the shaft portion 783 slides within the oblong hole 75, the shaft portion 783 pushes the wall portion 74 to the left. That causes the movement portion 63 to move toward the left and causes the inclined portions 641, 642 to move toward the left, as shown in FIG. 4. The movement of the wiper support portion 32 in the left-right direction is restricted by the guide wall portions 801, 802 (refer to FIG. 8). Therefore, as the inclined portions 641, 642 move, the wiper support portion 32, guided by the guide wall portions 801, 802, moves upward along the inclined portions 641, 642, against the energizing force of the coil spring 60. Then, when the CPU 40 stops operating the second drive portion 95, the wiper 31 and the wiper support portion 32 stop in the second contact position (refer to FIG. 4).

Next, the CPU 40 operates the first drive portion 94 (refer to FIG. 9) to move the absorption member 51 in the first direction in relation to the wiper 31 (Step S2). More specifically, as shown in FIG. 4, the first drive portion 94 is operated to rotate the rotating wall portion 931 through the drive shaft 932, thus rotating the shaft portion 933 around the drive shaft 932. As the shaft portion 933 slides within the oblong hole 854, the shaft portion 933 pushes the first wall portion 851 to the right. That causes the mount portion 85, the support portion 149, and the absorption member 51 to move in the first direction from a first position (refer to FIG. 4) to a second position (refer to FIG. 11). Note that the first position is the position at the left end of the range of movement in the left-right direction for the mount portion 85, the support portion 149, and the absorption member 51, and the second position is the position at the right end of the range of movement. As shown in FIG. 11, in a case where the mount portion 85, the support portion 149 and the absorption member 51 are in the second position, the upper edge of the wiper 31 is positioned inside the surface groove 213.

As shown in FIG. 12, in the course of the absorption member 51 moving in the first direction, the upper edge of a left face 311 of the wiper 31 comes into contact with a right edge face 221A of the first region 221 (refer to part (1) of FIG. 12). Next, as the wiper 31 bends, the upper edge of the left face 311 slides on the bottom face of the first region 221 (refer to part (2) of FIG. 12). When the wiper 31 moves into the surface groove 211, the wiper 31, which had been bent (refer to part (2) of FIG. 12), extends upward, and the upper edge of the left face 311 comes into contact with a right edge face 222A of the second region 222 (refer to part (3) of FIG. 12).

Next, as the wiper 31 bends, the upper edge of the left face 311 slides on the bottom face of the second region 222 (refer to part (4) of FIG. 12). When the wiper 31 moves into the surface groove 212, the wiper 31, which had been bent (refer to part (4) of FIG. 12), extends upward, and the upper edge of the left face 311 comes into contact with a right edge face 223A of the third region 223 (refer to part (5) of FIG. 12). Next, as the wiper 31 bends, the upper edge of the left face 311 slides on the bottom face of the third region 223 (refer to part (6) of FIG. 12). When the wiper 31 moves into the surface groove 213, the wiper 31, which had been bent (refer to part (6) of FIG. 12), extends upward (refer to FIG. 11). When the CPU 40 stops operating the first drive portion 94, the mount portion 85, the support portion 149 and the absorption member 51 stop in the second position (refer to FIG. 11).

Next, the CPU 40 operates the first drive portion 94 (refer to FIG. 9) to move the absorption member 51 in the second direction in relation to the wiper 31 (Step S3). More specifically, as shown in FIG. 11, the first drive portion 94 is operated to rotate the rotating wall portion 931 through the drive shaft 932, thus rotating the shaft portion 933 around the drive shaft 932. As the shaft portion 933 slides within the oblong hole 854, the shaft portion 933 pushes the first wall portion 851 to the left. That causes the mount portion 85, the support portion 149, and the absorption member 51 to move in the second direction from the second position (refer to FIG. 11) to the first position (refer to FIG. 4).

Figure 13:
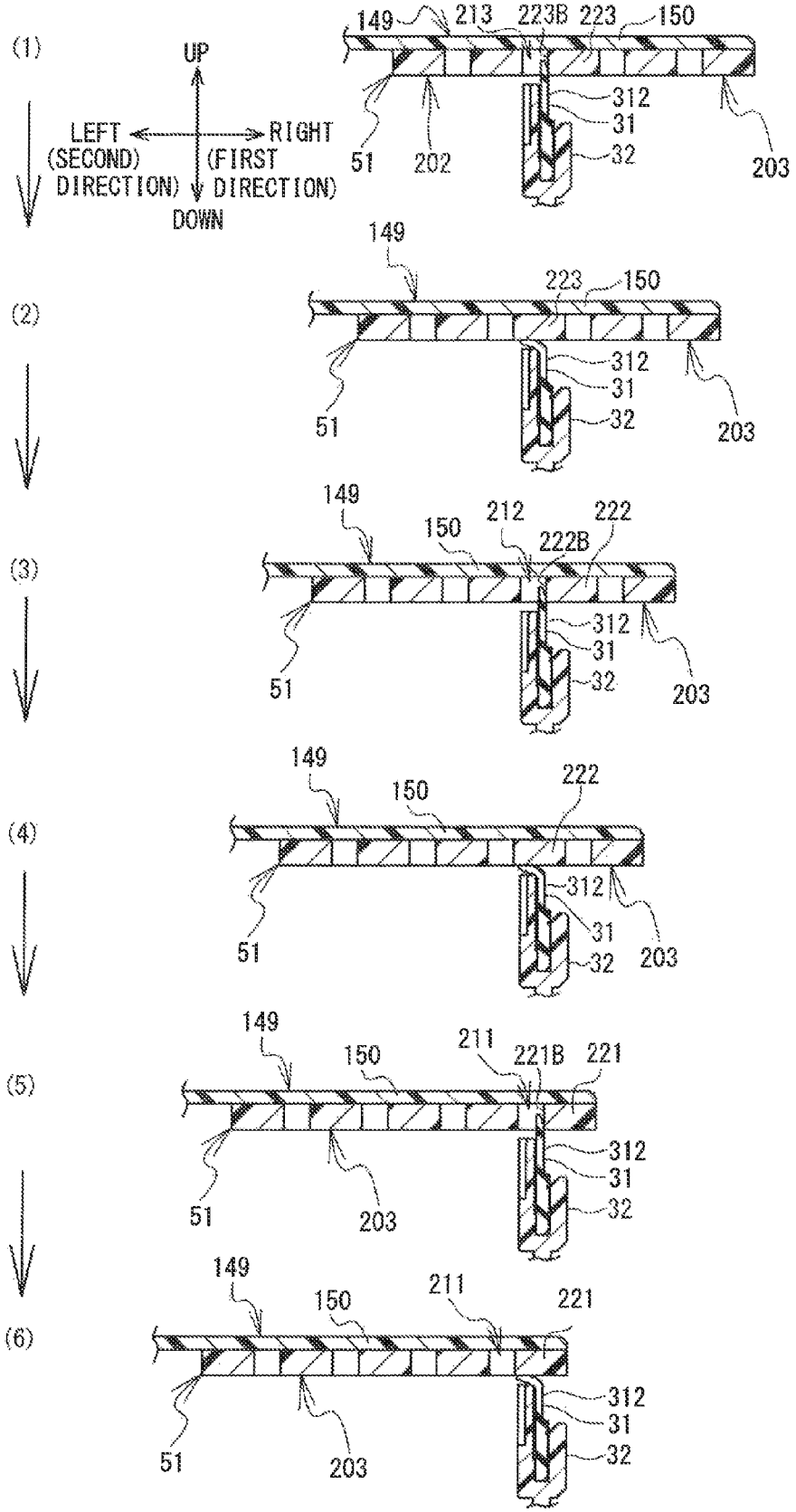
FIG. 13 is a state transition diagram showing a process by which the absorption member moves from the second position to the first position in the wiper wiping processing.

As shown in FIG. 13, in the course of the absorption member 51 moving, the upper edge of a right face 312 of the wiper 31 comes into contact with a left edge face 223B of the third region 223 (refer to part (1) of FIG. 13). Next, as the wiper 31 bends, the upper edge of the right face 312 slides on the bottom face of the third region 223 (refer to part (2) of FIG. 13). When the wiper 31 moves into the surface groove 212, the wiper 31, which had been bent (refer to part (2) of FIG. 13), extends upward, and the upper edge of the right face 312 comes into contact with a left edge face 222B of the second region 222 (refer to part (3) of FIG. 13).

Next, as the wiper 31 bends, the upper edge of the right face 312 slides on the bottom face of the second region 222 (refer to part (4) of FIG. 13). When the wiper 31 moves into the surface groove 211, the wiper 31, which had been bent (refer to part (4) of FIG. 13), extends upward, and the upper edge of the right face 312 comes into contact with a left edge face 221B of the first region 221 (refer to part (5) of FIG. 13). Next, as the wiper 31 bends, the upper edge of the right face 312 slides on the bottom face of the first region 221 (refer to part (6) of FIG. 13). When the first region 221 moves to the left of the wiper 31, the wiper 31, which had been bent (refer to part (6) of FIG. 13), extends upward (refer to FIG. 4). When the CPU 40 stops operating the first drive portion 94, the mount portion 85, the support portion 149 and the absorption member 51 stop in the first position (refer to FIG. 4).

Next, the CPU 40 operates the first drive portion 94 (refer to FIG. 9) to move the absorption member 51 in the first direction in relation to the wiper 31 (Step S4). That causes the mount portion 85, the support portion 149, and the absorption member 51 to move in the first direction (refer to FIG. 12) from the first position (refer to FIG. 4) to the second position (refer to FIG. 11). The processing at Step S4 is the same as at Step S2, so a detailed explanation will be omitted.

Next, the CPU 40 operates the second drive portion 95 (refer to FIG. 9) to move the wiper 31 and the wiper support portion 32 from the second contact position (refer to FIG. 11) to the separating position (refer to FIG. 3) (Step S5). More specifically, as shown in FIG. 4, the second drive portion 95 is operated to rotate the rotating wall portion 781 through the drive shaft 782, thus rotating the shaft portion 783 around the drive shaft 782. As the shaft portion 783 slides within the oblong hole 75, the shaft portion 783 pushes the wall portion 74 to the right. That causes the movement portion 63 to move toward the right and causes the inclined portions 641, 642 to move toward the right, as shown in FIG. 3. The movement of the wiper support portion 32 in the left-right direction is restricted by the guide wall portions 801, 802 (refer to FIG. 8). Therefore, as the inclined portions 641, 642 move, the wiper support portion 32, guided by the guide wall portions 801, 802, is moved downward along the inclined portions 641, 642 by the energizing force of the coil spring 60. Then, when the CPU 40 stops operating the second drive portion 95, the wiper 31 and the wiper support portion 32 stop in the separating position. At this time, the mount portion 85, the support portion 149 and the absorption member 51 are positioned in the second position (refer to FIG. 11).

Next, the CPU 40 operates the first drive portion 94 (refer to FIG. 9) to move the absorption member 51 in the second direction (Step S6). That causes the absorption member 51 and the mount portion 85 to move from the second position (refer to FIG. 11) to the first position (refer to FIG. 4). At this time, the wiper 31 has moved to the separating position (refer to FIG. 3), so the wiper 31 does not come into contact with the absorption member 51. Next, the CPU 40 terminates the wiper wiping processing.

The wiper wiping operation is performed as described above. In a case where the absorption member 51 has become soiled with ink and deteriorated after the wiper wiping operation has been performed several times, the operator replaces the absorption member 51 with a new absorption member 51. The method for replacing the absorption member 51 will be explained. Assume that the support portion 149 and the absorption member 51 are in the mounted orientation, as shown in part (1) of FIG. 14. The distance between the rounded face 165 and the rounded face 166 of each of the engagement lugs 161, 162 (refer to part (1) of FIG. 15) is longer than the left-to-right width of the opening 923 in each of the engagement slots 921, 922. Therefore, when the support portion 149 and the absorption member 51 are in the mounted orientation, the engagement lugs 161, 162 do not come out of the engagement slots 921, 922.

When the operator hooks a finger into the recessed portion 181 and pulls the recessed portion 181 upward, the respective engagements between the projections 171, 172 and the holes 901, 902 are released (refer to part (2) of FIG. 14). In a front view, the support portion 149 rotates clockwise around the engagement lugs 161, 162 disposed inside the engagement slots 921, 922, creating a state in which the support portion 149 extends upward, as shown in part (3) of FIG. 14. Note that when the support portion 149 rotates, the rounded faces 165, 166 of the engagement lugs 161, 162 slide along the inner faces of the engagement slots 921, 922, respectively.

With the support portion 149 in the state of extending upward, as shown in part (3) of FIG. 14, the operator pulls the support portion 149 upward. The distance between the flat face 163 and the flat face 164 of each of the engagement lugs 161, 162 is shorter than the left-to-right width of the opening 923 in each of the engagement slots 921, 922. Therefore, the support portion 149 is removed from the mount portion 85 by pulling the engagement lugs 161, 162 out of the respective engagement slots 921, 922 through the openings 923 in the engagement slots 921, 922, as shown in part (1) of FIG. 15.

Figure 15:
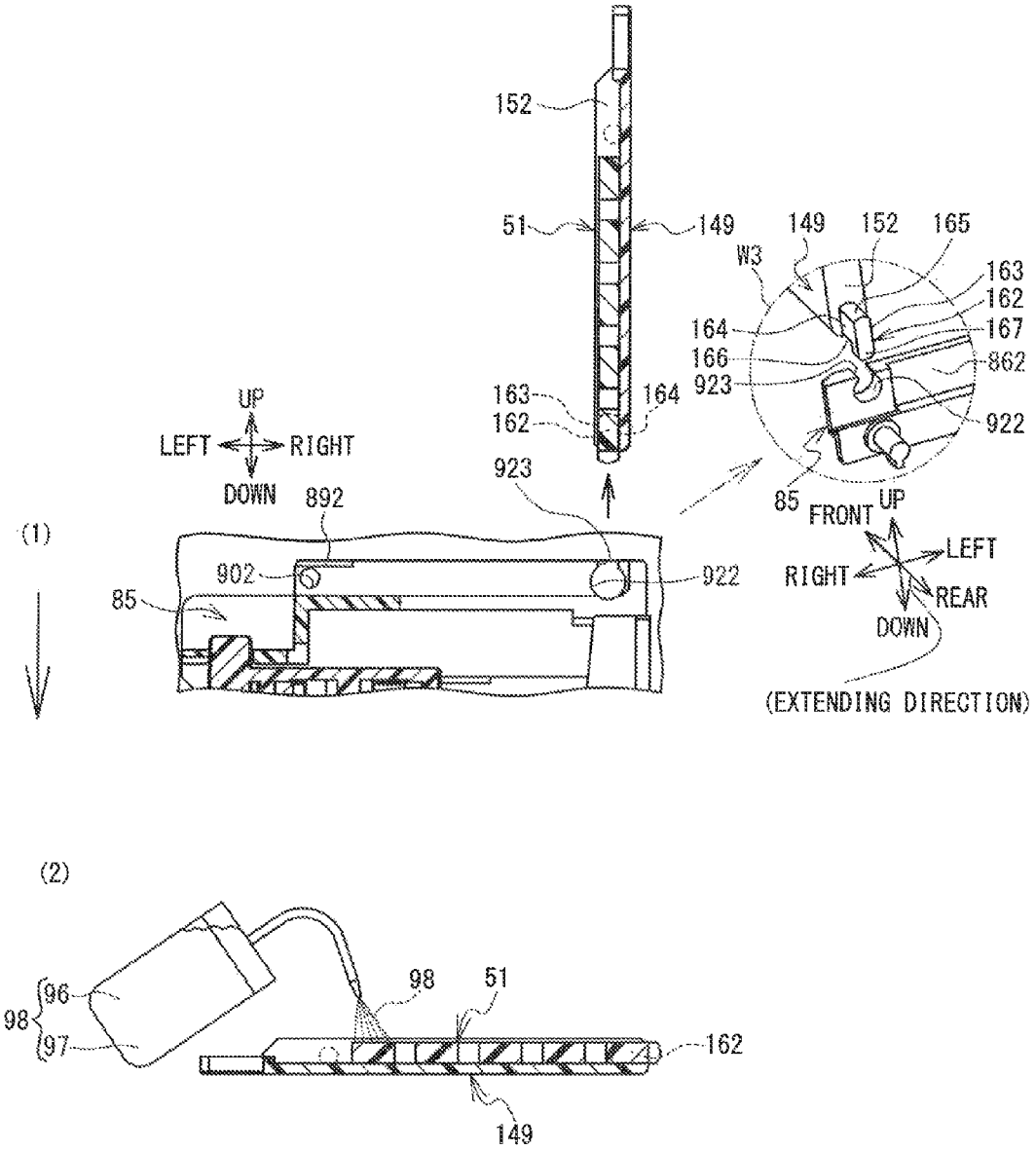
FIG. 15 is a state transition diagram that is a continuation of FIG. 14.

The operator removes the absorption member 51 from the support portion 149 and mounts the new absorption member 51 (refer to part (2) of FIG. 15) on the support portion 149. Note that the operator may also prepare both the new absorption member 51 and a new support portion 149. As shown in part (2) of FIG. 15, when the moistening solution 98 is supplied to the absorption member 51, the moistening solution 98 is absorbed by the absorption member 51. The moistening solution 98 is created by mixing the moistening agent 96 and the water 97 at a production plant, for example, and then shipped.

The support portion 149 on which the new absorption member 51 has been mounted (refer to part (2) of FIG. 15) is mounted on the mount portion 85 in the reverse order of the procedure that is described above. That is, in the state in which the support portion 149 extends upward, the engagement lugs 161, 162 are disposed in the engagement slots 921, 922, respectively. In a front view, the support portion 149 is rotated counterclockwise around the engagement lugs 161, 162. The projections 171, 172 slide past the chamfers 891, 892, respectively, and engage with the holes 901, 902, respectively. The support portion 149 and the absorption member 51 are thus disposed on the mount portion 85 (refer to part (1) of FIG. 14).

The printer 1 of the present embodiment is configured as described above. When the wiper wiping operation is performed (refer to FIGS. 12 and 13), the ink from the wiper 31 adheres to the absorption member 51. In the present embodiment, the absorption member 51 is moistened by the moistening solution 98. Therefore, the ink that adheres to the absorption member 51 is less likely to harden than it would be in a case where the absorption member 51 is dry and not moistened by the moistening solution 98. It is thus possible to reduce the possibility that the surface of the absorption member 51 will be clogged by ink hardened on the surface of the absorption member 51, making it more difficult to absorb the ink. Therefore, the possibility that ink will remain on the wiper 31 when the wiper wiping operation is performed can be reduced. Accordingly, the possibility can be reduced that the ink wiped off from the nozzle face 111 by the nozzle face wiping operation (refer to FIG. 6) will remain on the wiper 31, such that the remaining ink will once again adhere to the nozzle face 111 the next time the nozzle face wiping operation is performed, creating problems with the discharge of the ink from the nozzle face 111. Furthermore, because the ink is not likely to harden on the surface of the absorption member 51, the absorption member 51 can be replaced less frequently than in a case where the absorption member 51 is not moistened.

Moreover, because the contact portion 203 comes into contact with the wiper 31, as shown in FIGS. 12 and 13, the ink adhered to the upper edge on the absorption member 51 side of the wiper 31 is removed by the absorption member 51. Furthermore, the forming of the surface grooves 211 to 214 creates a greater number of edge faces in the left-right direction of the contact portion 203 than would be the case if the surface grooves 211 to 214 were not formed. That increases accordingly the number of times that the edge faces of the contact portion 203 come into contact with the left face 311 and the right face 312 of the wiper 31. In the present embodiment, during the movement of the absorption member 51 from the first position to the second position, the upper edge of the left face 311 of the wiper 31 comes into contact with the right edge faces 221A, 222A, 223A of the contact portion 203, as shown in FIG. 12. In other words, the upper edge of the left face 311 of the wiper 31 comes into contact with the edge faces of the contact portion 203 three times. Furthermore, as shown in FIG. 13, the upper edge of the right face 312 of the wiper 31 comes into contact with the left edge faces 221B, 222B, 223B of the contact portion 203 during the movement of the absorption member 51 from the second position to the first position. In other words, the upper edge of the right face 312 of the wiper 31 comes into contact with the edge faces of the contact portion 203 three times. Accordingly, the possibility that ink will remain on the tip and the side faces of the upper edge of the wiper 31 can be reduced from what it would be in a case where the surface grooves 211 to 214 are not provided. Therefore, the possibility can be reduced that the ink wiped off from the nozzle face 111 by the nozzle face wiping operation (refer to FIG. 6) will remain on the wiper 31, such that the remaining ink will once again adhere to the nozzle face 111 the next time the nozzle face wiping operation is performed, creating problems with the discharge of the ink from the nozzle face 111.

The wiper 31 also changes a plurality of times from a state in which it is in contact with the bottom face of the contact portion 203 to a state in which it is inside one of the surface grooves 211 to 214 (refer to FIGS. 12 and 13). In the course of these changes, the bending of the wiper 31 is released, and the wiper 31 extends upward. The movement by which the bent state of the wiper 31 changes to the extended state of the wiper 31 causes the ink that adheres to the wiper 31 to fly off from the wiper 31 and drop into the non-printing area 140. Accordingly, the amount of ink that the absorption member 51 absorbs becomes less than it would be in a case where the ink does not fly off from the wiper 31, so the absorption member 51 can be replaced less frequently.

In a known inkjet recording device, an ink removal member moves in conjunction with the movement of a carriage. Therefore, the ink removal member moves into a printing area together with the carriage. At this time, there is a possibility that vibration that accompanies the movement of the carriage will cause the ink adhered to the ink removal member to fly off from the ink removal member, and that the ink will then drop onto a printing medium disposed in the printing area.

In the present embodiment, because the wiper 31 and the absorption member 51 are provided separately from the head 110, the ink that adheres to the wiper 31 and absorption member 51 tends not to fly off, even if the head 110 vibrates. Moreover, because the wiper 31 and the absorption member 51 are provided in the non-printing area 140, the possibility that the ink that adheres to the wiper 31 and absorption member 51 will drop onto the printing medium disposed in the printing area 130 can be reduced. The possibility can also be reduced that the moistening solution 98 moistening the absorption member 51 will drop onto the printing medium disposed in the printing area 130.

Furthermore, because the support portion 149 that supports the absorption member 51 can be mounted on and removed from the mount portion 85, the absorption member 51 can be replaced more easily than would be the case if the support portion 149 could not be mounted on and removed from the mount portion 85.

Further, in the present embodiment, the support portion 149 can be removed from the mount portion 85 by rotating the support portion 149 around the engagement lugs 161, 162 in the engagement slots 921, 922 and pulling the engagement lugs 161, 162 out of the engagement slots 921, 922 through the openings 923 in the engagement slots 921, 922, as shown in FIGS. 14 and 15. Moreover, the support portion 149 can be mounted on the mount portion 85 by putting the engagement lugs 161, 162 into the engagement slots 921, 922 through the openings 923 in the engagement slots 921, 922, then rotating the support portion 149 around the engagement lugs 161, 162. The support portion 149 can thus be mounted on and removed from the mount portion 85 more easily than would be the case if the engagement lugs 161, 162 were engaged by being passed through holes, for example. The task of replacing the absorption member 51 thus becomes easier.

Furthermore, the wiper 31 moves in the up-down direction (refer to FIGS. 3, 4, and 6), and the absorption member 51 moves horizontally in the left-right direction (refer to FIGS. 12 and 13). In other words, the wiper 31 and the absorption member 51 each move only in two opposing directions. Therefore, a simple configuration that removes the ink from the wiper 31 can be created more easily than would be the case if the wiper 31 was configured to move both horizontally and vertically. Furthermore, because a simple configuration that removes the ink from the wiper 31 can be created, it is easier to ensure working space for replacing the absorption member 51 within the non-printing area 140, where space is limited. The absorption member 51 can thus be replaced easily.

Figure 10:
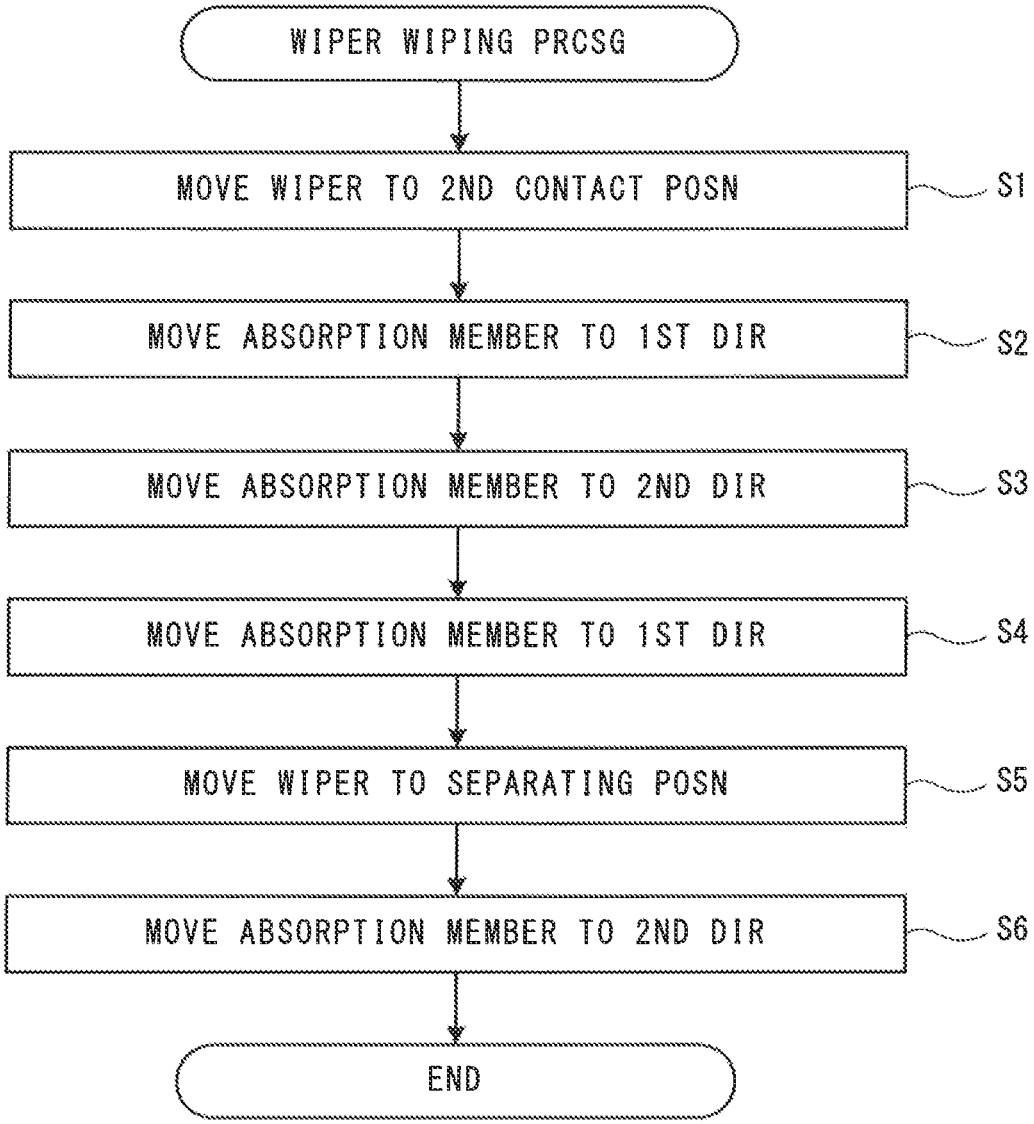
FIG. 10 is a flowchart of wiper wiping processing.

In the processing at Steps S2 to S4, as shown in FIG. 10, the ink adhered to the upper edge on the absorption member 51 side of the wiper 31 is removed by the absorption member 51. Further, at Step S2, when the absorption member 51 moves in the first direction in relation to the wiper 31, the ink adhered to the upper edge of the left face 311 of the wiper 31 is removed by the absorption member 51 (refer to FIG. 12). At Step S3, when the absorption member 51 moves in the second direction in relation to the wiper 31, the ink adhered to the upper edge of the right face 312 of the wiper 31 is removed by the absorption member 51. At this time, there is a possibility that some of the ink adhered to the wiper 31 will be pushed by the absorption member 51 and will move to the upper edge of the left face 311 of the wiper 31. However, at Step S4, the absorption member 51 once again moves in the first direction in relation to the wiper 31, so the ink that has moved to the upper edge of the left face 311 of the wiper 31 is removed by the absorption member 51. The ink can thus be removed from the wiper 31 more reliably.

In particular, in the nozzle face wiping operation, the upper edge of the left face 311 of the wiper 31 slides on the nozzle face 111 (refer to FIG. 6). Therefore, the ink can be removed from the nozzle face 111 by the left face 311, from which the ink has been more reliably removed by the absorption member 51. The ink can thus be removed from the nozzle face 111 more reliably. Therefore, the possibility that ink will remain on the nozzle face 111 and cause problems with the discharge of the ink from the nozzle face 111 can be reduced.

Furthermore, end portions 231, 232 in the extending direction of each of the surface grooves 211 to 214 are positioned farther to the inside of the absorption face 202 than are edge portions 241, 242 in the extending direction of the absorption face 202. In other words, the surface grooves 211 to 214 are positioned to the inside of the absorption face 202. Therefore, the absorption member 51 can be created by using a press or the like to form the surface grooves 211 to 214 by making recessed portions or through-holes to the inside of the absorption face 202, for example. The absorption member 51 can thus be made more easily than would be the case if the absorption member 51 was made by attaching a plurality of the contact portions 203 to a plate-shaped member, for example.

The moistening agent 96 is contained in the moistening solution 98, as shown in part (2) of FIG. 15. Therefore, the absorption member 51 is less likely to dry out than it would be in a case where the moistening agent 96 was not contained in the moistening solution 98. It is thus possible to perform the work of supplying the moistening solution 98 to the absorption member 51 less frequently.

Moreover, the solvent of the moistening solution 98 is the water 97. Therefore, the moistening solution 98 can be manufactured less expensively than would be the case if a special liquid other than the water 97 was used.

Note that the present disclosure is not limited to the embodiment that is described above, and various types of modifications can be made. For example, the solvent of the moistening solution 98 is water. However, the solvent may also be a different liquid, such as a glycol or the like that is mixture of glycerin and alcohol or the like. The moistening solution 98 also contains the moistening agent 96, but it does not necessarily have to contain a moistening agent. The liquid that moistens the absorption member 51 may also be water only. The liquid that moistens the absorption member 51 may also be only a liquid other than water.

Furthermore, as shown in FIG. 7, the end portions 231, 232 in the extending direction of each of the surface grooves 211 to 214 are positioned farther to the inside of the absorption face 202 than are edge portions 241, 242 in the extending direction of the absorption face 202. However, the surface grooves 211 to 214 may also extend through the absorption face 202 in the front-rear direction. At Steps S2 to S4 (refer to FIG. 10), the absorption member 51 makes one-and-a-half round trips between the first position and the second position, but the present disclosure is not limited to this configuration, and it is also acceptable for only Step S2 to be executed, for example. It is also acceptable for only Steps S2 and S3 to be executed.

Furthermore, the wiper wiping operation is performed by moving the absorption member 51 in the left-right direction, but the present disclosure is not limited to this configuration. It is necessary only for the absorption member 51 to move in relation to the wiper 31, and the wiper wiping operation may also be performed by moving the wiper 31 in the left-right direction in relation to the absorption member 51, for example. Furthermore, the nozzle face wiping operation is performed by moving the head 110 in the left-right direction, but the present disclosure is not limited to this configuration. It is necessary only for the wiper 31 to move in relation to the nozzle face 111, and the nozzle face wiping operation may also be performed by moving the wiper 31 in the left-right direction in relation to the nozzle face 111, for example. When the support portion 149 has been mounted on the mount portion 85, the projections 171, 172 are disposed inside of and engaged with the holes 901, 902, respectively, but the present disclosure is not limited to this configuration. For example, hooks may also be provided on the support portion 149, and the hooks may engage with the mount portion 85.

The shapes of the engagement lugs 161, 162 are also not limited, and they may also be circular cylinders, for example. The support portion 149 is disposed on the mount portion 85 by detachably mounting the engagement lugs 161, 162 in the engagement slots 921, 922, respectively, through the openings 923 in the engagement slots 921, 922, but the present disclosure is not limited to this configuration. For example, holes that do not have openings may be provided in the side walls 151, 152, and the support portion 149 may also be mounted on the mount portion 85 by engaging the engagement lugs 161, 162 by inserting them into the corresponding holes. The engagement lugs 161, 162 and the engagement slots 921, 922 are provided as corresponding pairs, but it is also acceptable, for example, for only one of the engagement lugs 161, 162 and only the corresponding one of the engagement slots 921, 922 to be provided. The support portion 149 can be mounted on and removed from the mount portion 85, but it is also acceptable for the support portion 149 not to be removable. The wiper 31 and the absorption member 51 are provided in the non-printing area 140, but they may also be provided in the printing area 130. The liquid that is discharged from the nozzle face 111 are not limited to being ink, and it may also be a stripping agent that removes a color with which a cloth has been dyed. In the embodiment described above, the number of the surface grooves 211 etc. can be modified. That is, it is sufficient that the absorption member 51 has at least one surface groove such as the surface groove 211.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer, comprising:

a head provided with a nozzle face having a nozzle discharging a first liquid;

a wiper configured to contact to the nozzle face and to move in relation to the nozzle face;

an absorption member configured to be moistened by a second liquid, the absorption member being configured to absorb the first liquid adhered to the wiper while moving in relation to the wiper;

the absorption member having a contact portion and a plurality of surface grooves;

the contact portion being provided on a side of an absorption face of the absorption member so as to come into contact with the wiper, the absorption face being a face on a side of the absorption member facing the wiper;

the surface grooves being provided on an absorption face side, each of the surface grooves being a groove extending along an extending direction, the extending direction being a direction in which an edge on an absorption member side of the wiper extends and a direction parallel to the nozzle face, the surface groove being recessed in a direction apart from the wiper than the contact portion, and each of the surface grooves having a length in an orthogonal direction being larger than the length of the wiper in the orthogonal direction, the orthogonal direction being orthogonal to the extending direction, the orthogonal direction being parallel to the nozzle face.

2. The printer according to claim 1, further comprising:

a support portion configured to support the absorption member; and a mount portion configured to removably mount the support portion thereon.

3. The printer according to claim 2, wherein the support portion includes an engagement lug provided to project in the extending direction from an edge of the support portion, the mount portion includes an engagement slot formed in the extending direction so as to engage with the engagement lug, and the engagement slot is open on a side facing the head.

4. The printer according to claim 3, further comprising:

a first movement mechanism configured to move the absorption member horizontally;

a second movement mechanism configured to move the wiper up and down; and a drive portion configured to drive the first movement mechanism and the second movement mechanism.

5. The printer according to claim 4, further comprising a controller provided to control the drive portion, wherein the controller is configured to perform a process including steps of:

first movement of the absorption member horizontally in a first direction in relation to the wiper;

second movement of the absorption member in a second direction in relation to the wiper after the first movement, the second direction being the opposite direction from the first direction; and third movement of the absorption member in the first direction after the second move.

6. The printer according to claim 5, wherein the first movement is to move the absorption member in the first direction from a first position to a second position, the first position being a position where the wiper is apart from the absorption member, the second position being a position where an edge of the wiper is positioned inside the surface groove; and the second movement is to move the absorption member from the second position to the first position in the second direction.

7. The printer according to claim 1, wherein an edge on the extending direction side of the surface groove is positioned farther to the inside of the absorption face than is an edge on the extending direction side of the absorption face.

8. The printer according to claim 1, wherein the second liquid contains water as a solvent and a moistening agent.

9. The printer according to claim 1, further comprising:

a first movement mechanism configured to move the absorption member horizontally;

a second movement mechanism configured to move the wiper up and down; and a drive portion configured to drive the first movement mechanism and the second movement mechanism.

10. The printer according to claim 9, further comprising a controller provided to control the drive portion, wherein the controller is configured to perform a process including steps of:

first movement of the absorption member horizontally in a first direction in relation to the wiper;

second movement of the absorption member in a second direction in relation to the wiper after the first move, the second direction being the opposite direction from the first direction; and third movement of the absorption member in the first direction after the second move.

11. The printer according to claim 10, wherein the first movement is to move the absorption member in the first direction from a first position to a second position, the first position being a position where the wiper is apart from the absorption member, the second position being a position where an edge of the wiper is positioned inside the surface groove; and the second movement is to move the absorption member from the second position to the first position in the second direction.

12. The printer according to claim 1, wherein the wiper and the absorption member are provided in a non-printing area, the non-printing area being an area outside of a printing area in a moving path of the head, the printing area being an area within which printing is performed by the head in the moving path.

13. The printer according to claim 6, wherein the plurality of surface grooves include a first surface groove and a second surface groove, the first surface groove being provided on close side to the first position, the second surface groove being provided on distant side from the first position with respect to the first surface groove, the second position being a position where an edge of the wiper is positioned inside the second surface groove.

14. The printer according to claim 5, wherein the plurality of surface grooves include a first surface groove and a second surface groove, the first surface groove being provided on close side to the first position, the second surface groove being provided on distant side from the first position with respect to the first surface groove; and the first movement is to move the absorption member to a return position, the return position being located in the second groove side than the first groove.

* * * * *